US009829223B2

(12) United States Patent
El-Shaarawi

(10) Patent No.: US 9,829,223 B2
(45) **Date of Patent: *Nov. 28, 2017**

(54) SOLAR DRIVEN REFRIGERATION SYSTEM

(71) Applicant: KING FAHD UNIVERSITY OF PETROLEUM AND MINERALS, Dhahran (SA)

(72) Inventor: Maged Ahmed El-Shaarawi, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/487,961

(22) Filed: Apr. 14, 2017

(65) Prior Publication Data

US 2017/0292738 A1 Oct. 12, 2017

Related U.S. Application Data

(63) Continuation of application No. 15/096,909, filed on Apr. 12, 2016, now Pat. No. 9,671,144.

(51) Int. Cl.
*F25B 27/00* (2006.01)

(52) U.S. Cl.
CPC .... *F25B 27/005* (2013.01); *F25B 2400/0409* (2013.01); *F25B 2400/06* (2013.01); *F25B 2400/16* (2013.01)

(58) Field of Classification Search
CPC ..... F25B 17/086; F25B 27/005; F25B 27/007
See application file for complete search history.

(56) References Cited

U.S. PATENT DOCUMENTS

| | | | |
|---|---|---|---|
| 1,803,074 | A | 4/1931 | Schickler |
| 4,439,994 | A | 4/1984 | Briley |
| 4,633,674 | A | 1/1987 | Sato |
| 5,237,827 | A | 8/1993 | Tchernev |
| 2005/0252235 | A1 | 11/2005 | Critoph |
| 2007/0033958 | A1 | 2/2007 | Jang |
| 2008/0047285 | A1 | 2/2008 | Boule |
| 2014/0190195 | A1 | 7/2014 | Muscatell |
| 2014/0223945 | A1 | 8/2014 | Rahl |
| 2015/0101789 | A1 | 4/2015 | Enomoto et al. |

FOREIGN PATENT DOCUMENTS

| | | |
|---|---|---|
| EP | 2 669 585 A1 | 12/2013 |
| KR | 10-1316691 B1 | 10/2013 |

*Primary Examiner* — Christopher R Zerphey
(74) *Attorney, Agent, or Firm* — Oblon, McClelland, Maier & Neustadt, L.L.P.

(57) ABSTRACT

Aspects of the disclosure provide a system and method for thermal-compression refrigeration. The refrigeration system includes a storage tank that stores a refrigerant condensate from a condenser, a mixing chamber that receives a refrigerant vapor from an evaporator and a portion of the refrigerant condensate from the storage tank, and produces a refrigerant mixture of the refrigerant vapor and the portion of the refrigerant condensate, and a first and second refrigerant compressors between the mixing chamber and condenser. The first and second refrigerant compressors each receives the refrigerant mixture from the mixing chamber, compresses the refrigerant mixture to produce a compressed refrigerant using thermal energy, and is capable of operating in a heater mode or a cooler mode.

15 Claims, 20 Drawing Sheets

Refrigeration system

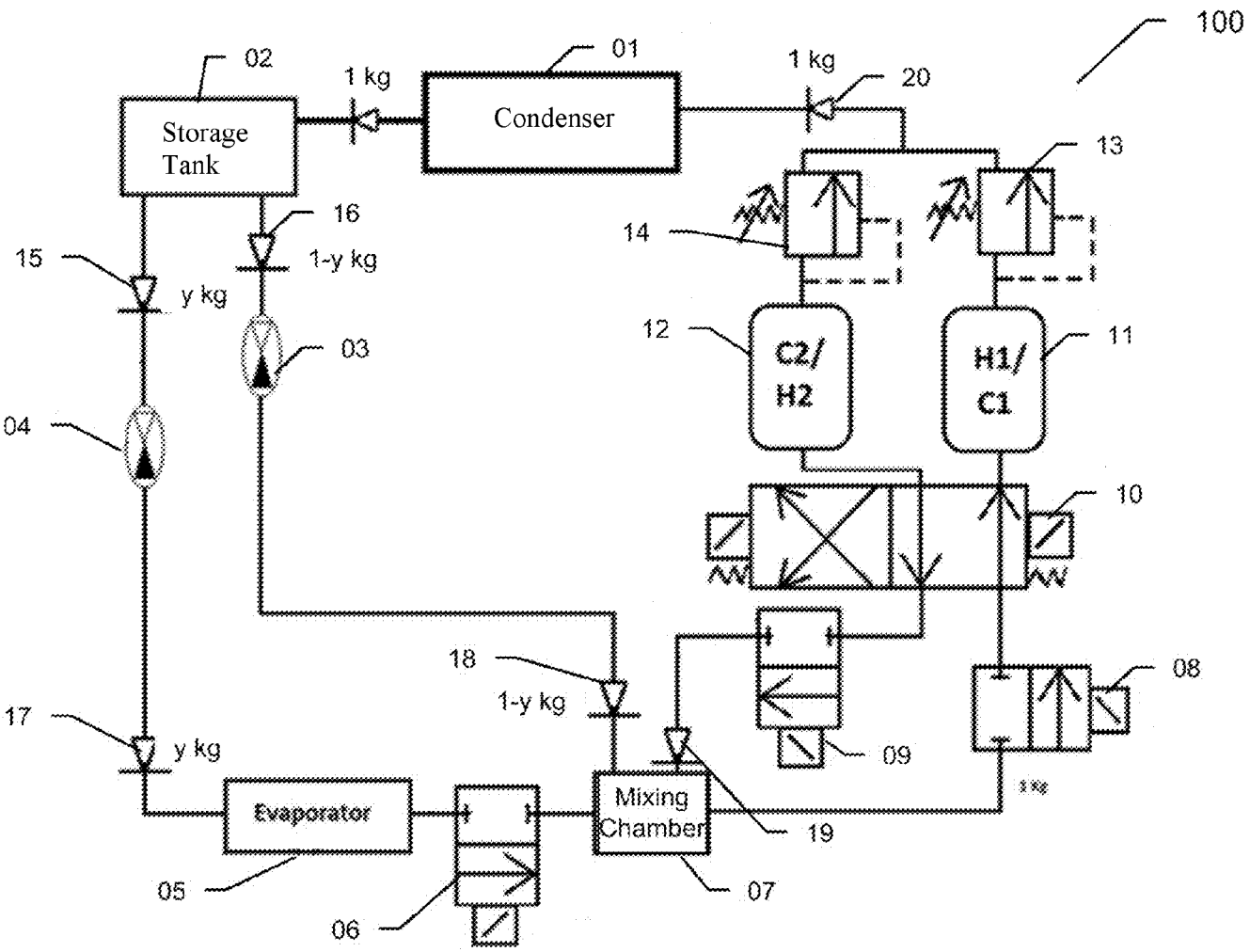
Fig. 1 Refrigeration system

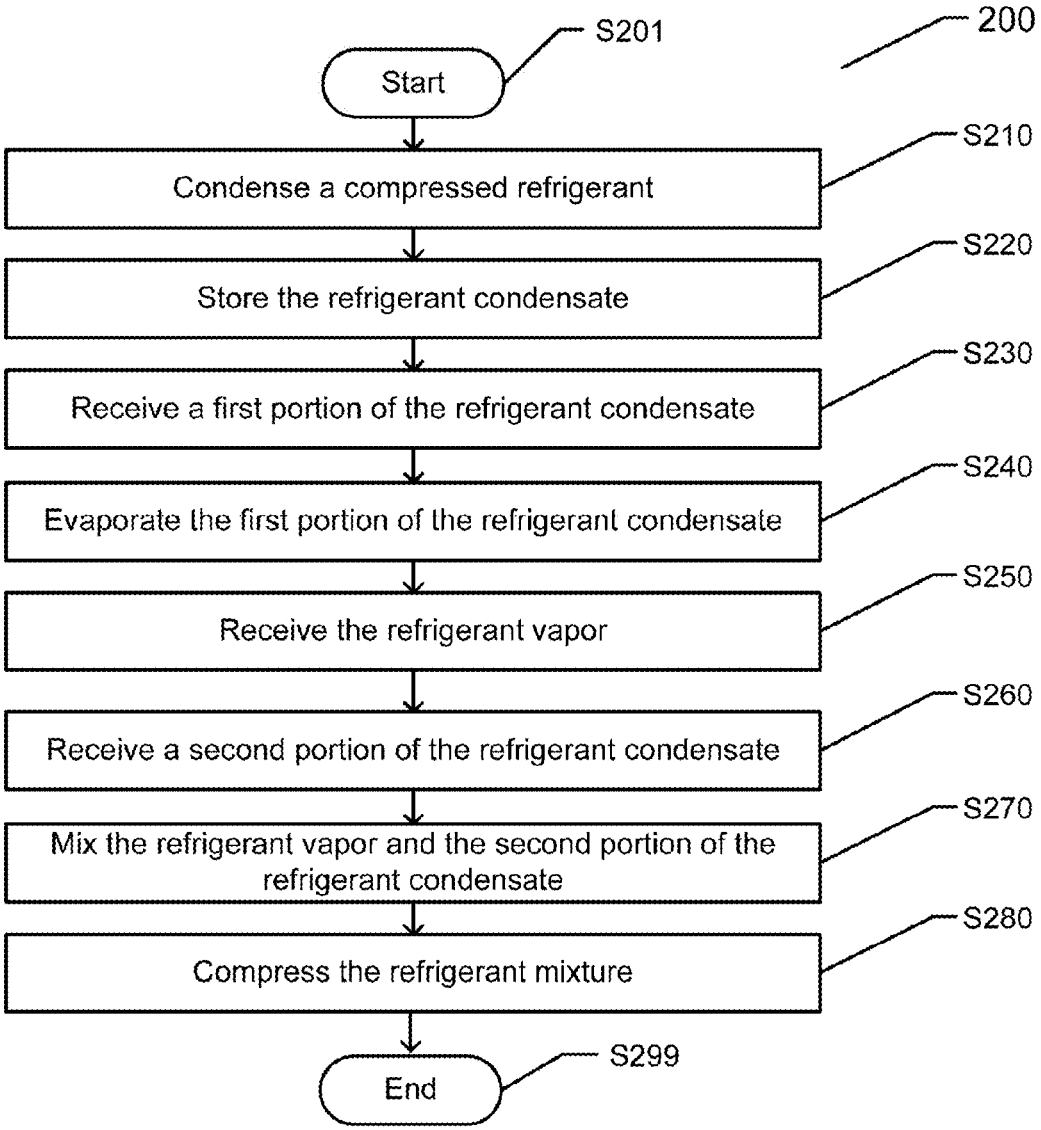
Fig. 2 Process for thermal-compression refrigeration

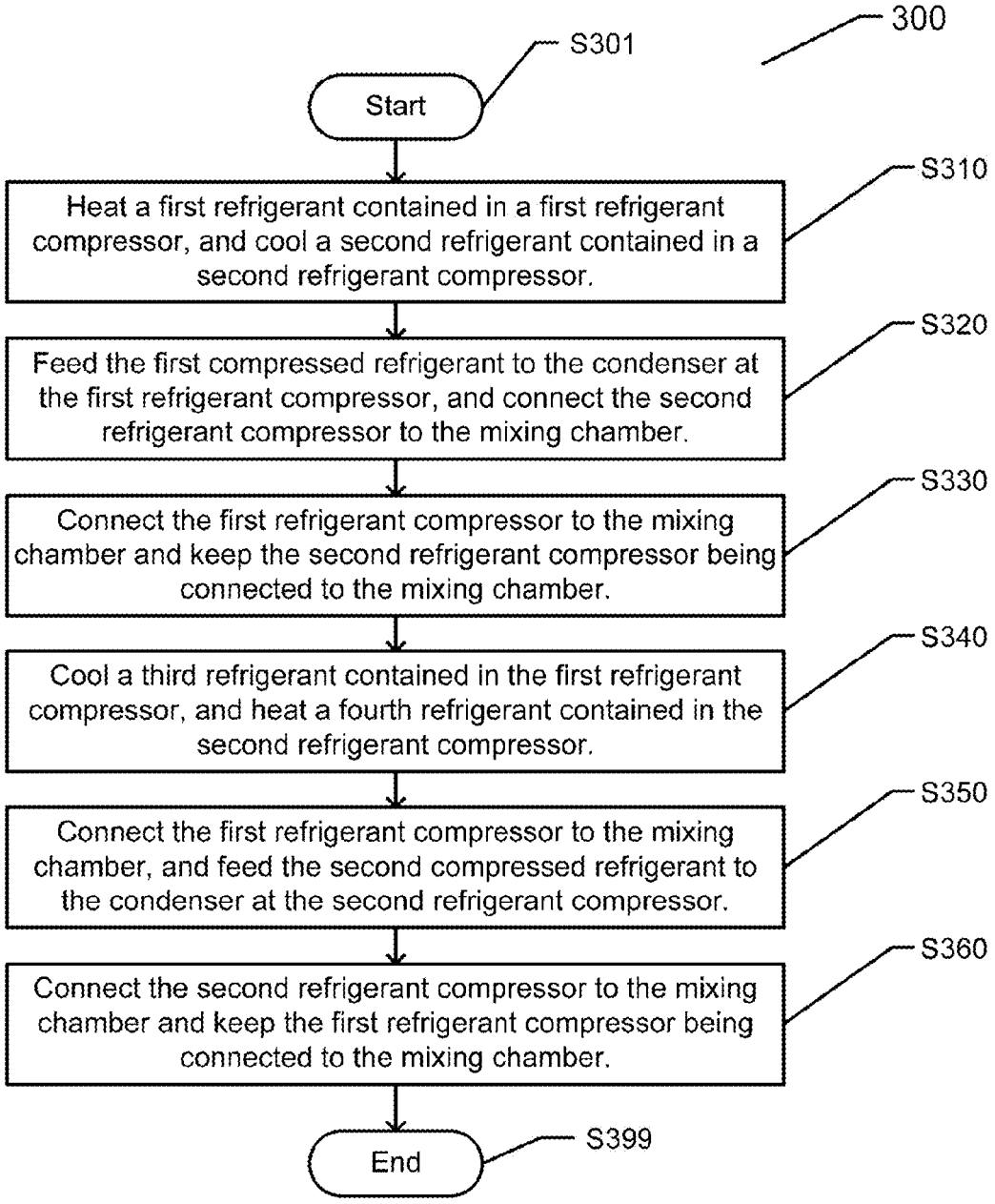
Fig. 3 Process for compressing the refrigerant mixture to produce a compressed refrigerant

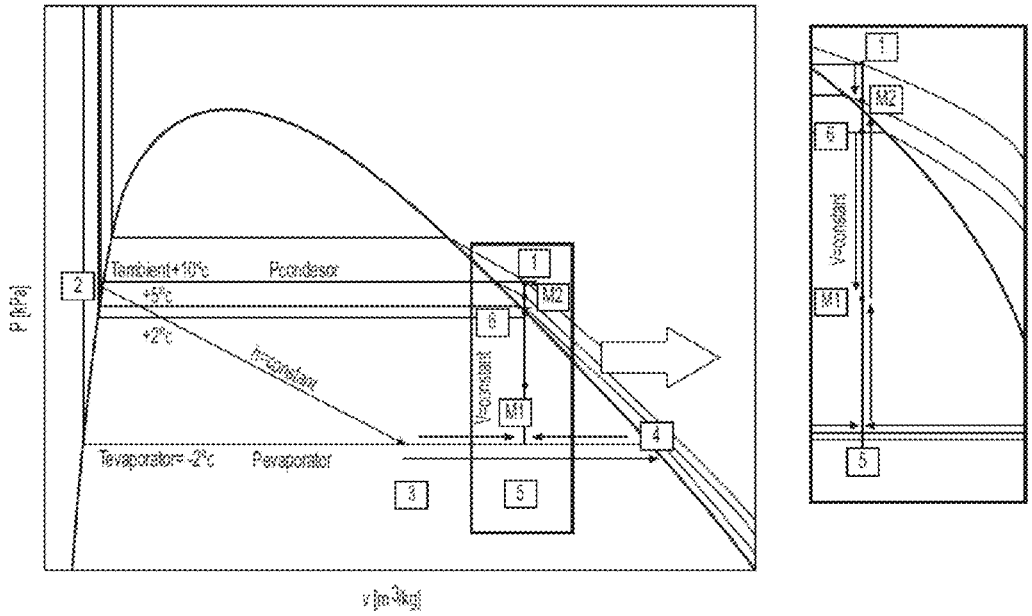
Fig. 5A Typical P-v diagram for a system cycle including two unsteady mixing processes (M1 and M2)
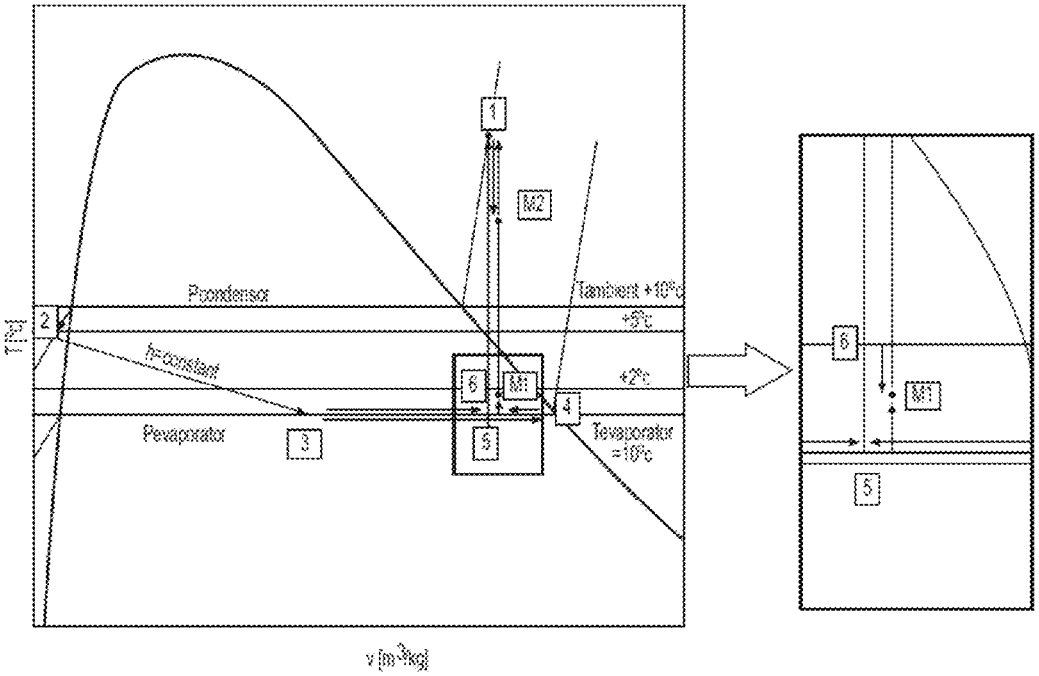
Fig. 5B Typical T-v diagram for a system cycle including two unsteady mixing processes (M1 and M2)

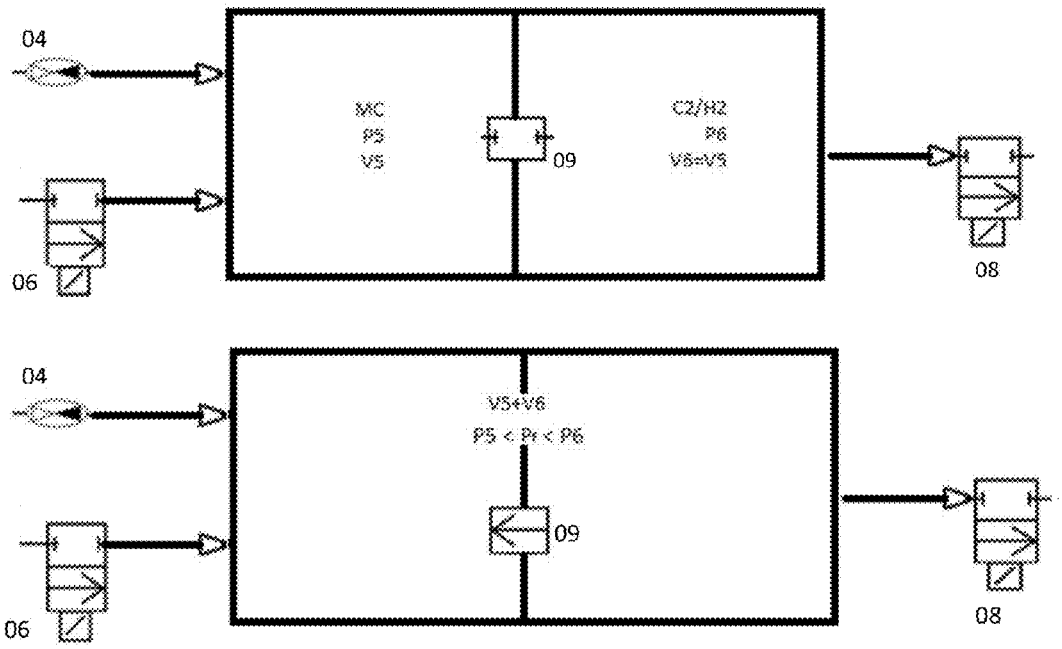
Fig. 6A Schematic diagram for an first unsteady mixing process
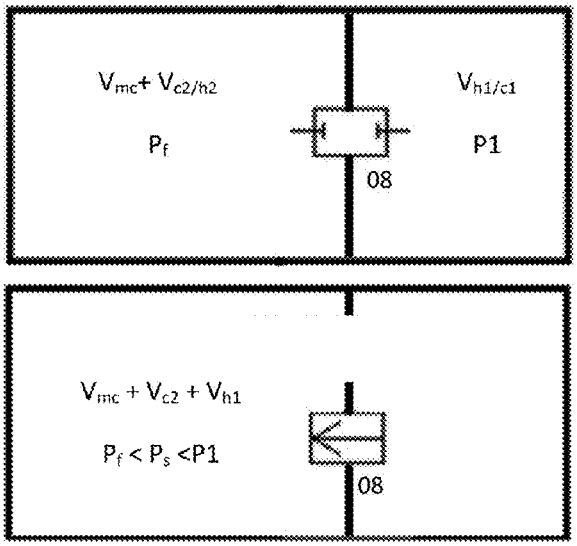
Fig. 6B Schematic diagram for an second unsteady mixing process

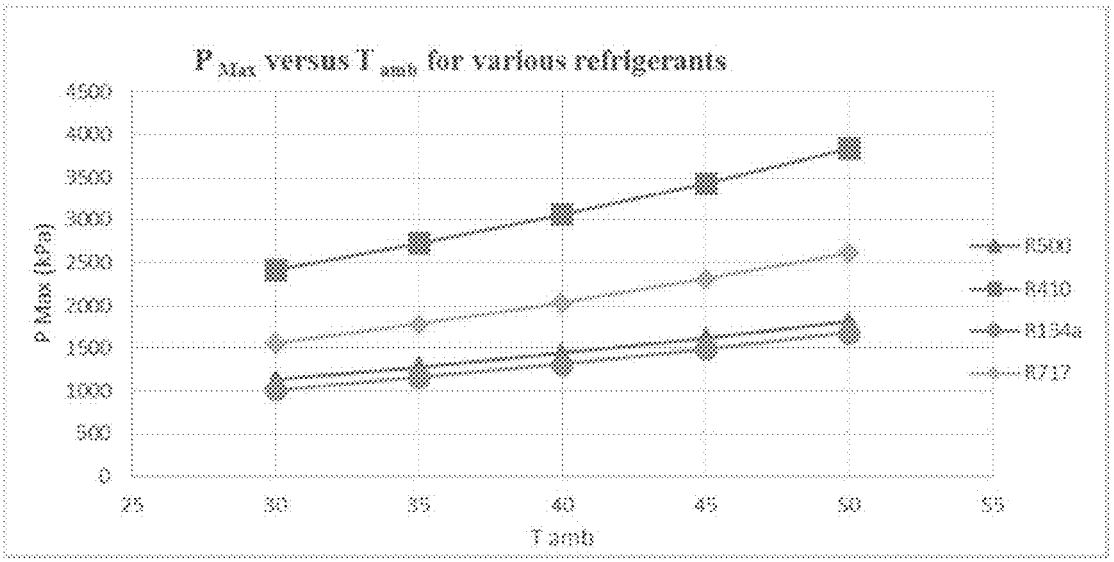
Fig. 8C Maximum pressure (condenser pressure) versus the ambient temperature for four refrigerants

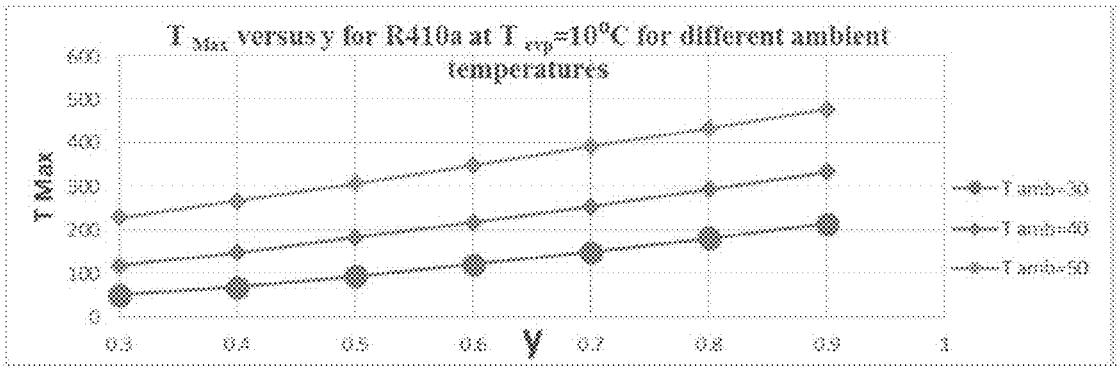
Fig. 10A Maximum temperature versus the extraction ratio (y) for R410a at Tevap=10℃ and different ambient temperatures
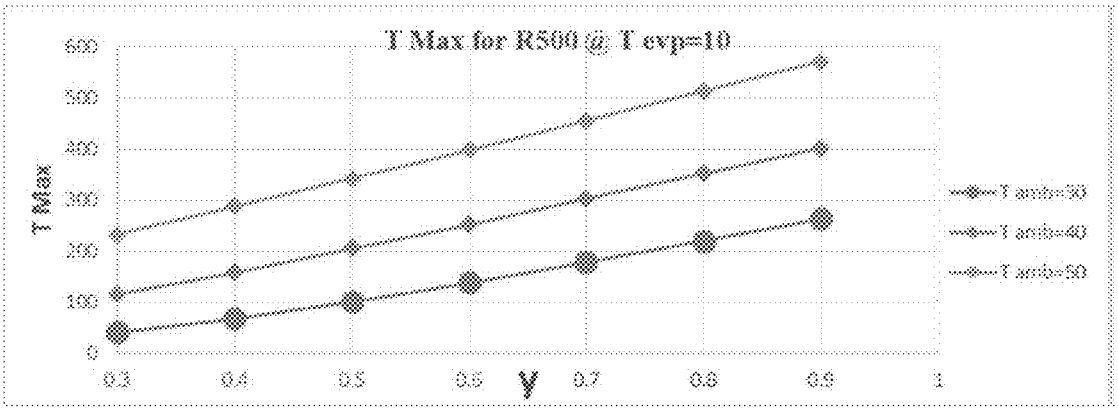
Fig. 10B Maximum temperature versus the extraction ratio (y) for R500 at Tevap=10℃ and different ambient temperatures

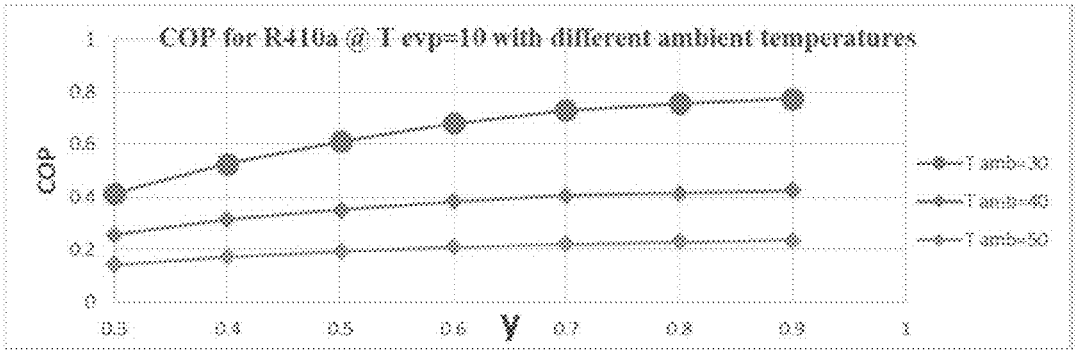
Fig. 10C COP versus the extraction ratio (y) for R410a at T evap = 10℃ and different ambient temperatures
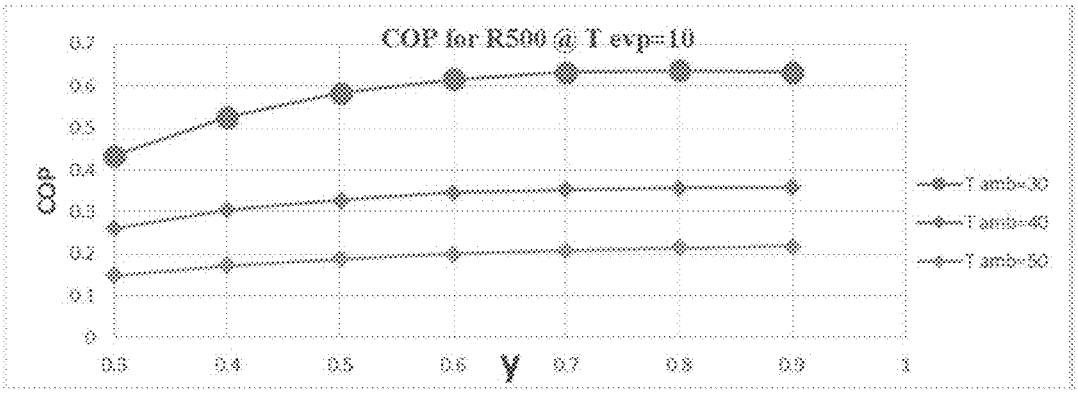
Fig. 10D COP versus the extraction ratio (y) for R500 at Tevap=10℃ and different ambient temperatures

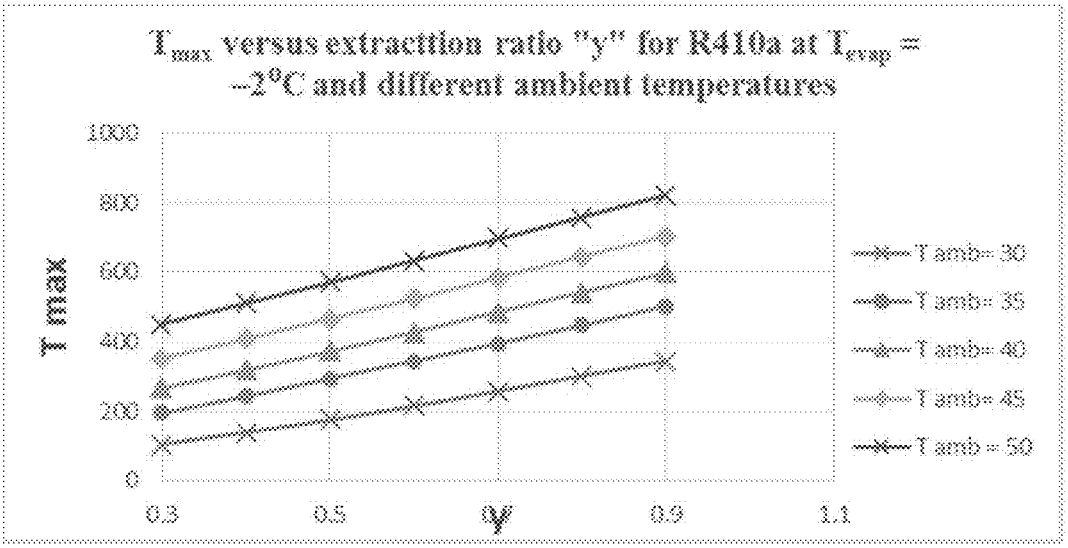
Fig. 12A Maximum temperature versus the extraction ratio (y) for R410a at Tevap= –2℃ and different ambient temperatures
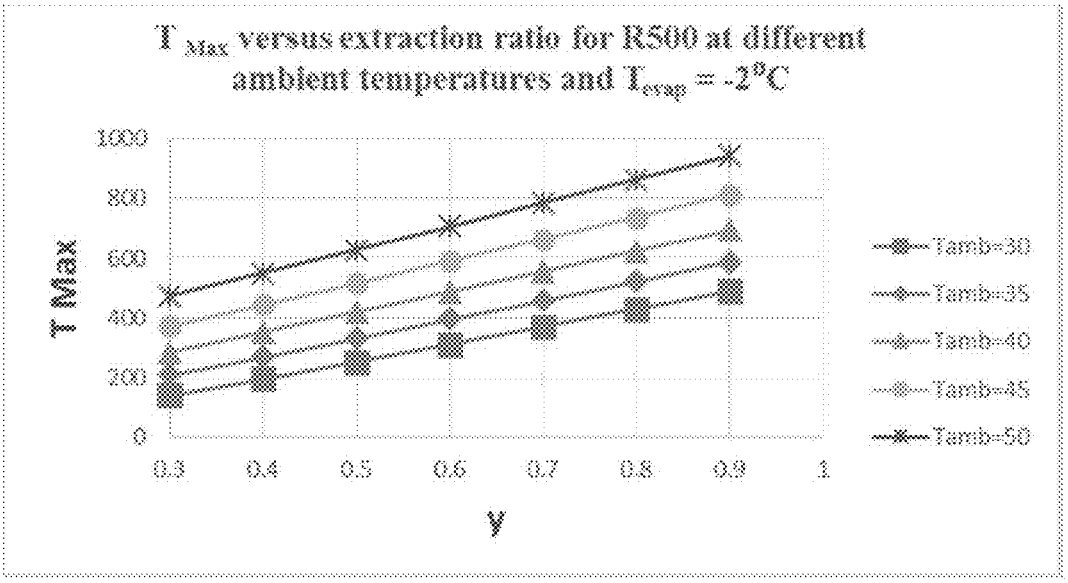
Fig. 12B Maximum temperature versus the extraction ratio (y) for R500 at Tevap= –2℃ and different ambient temperatures

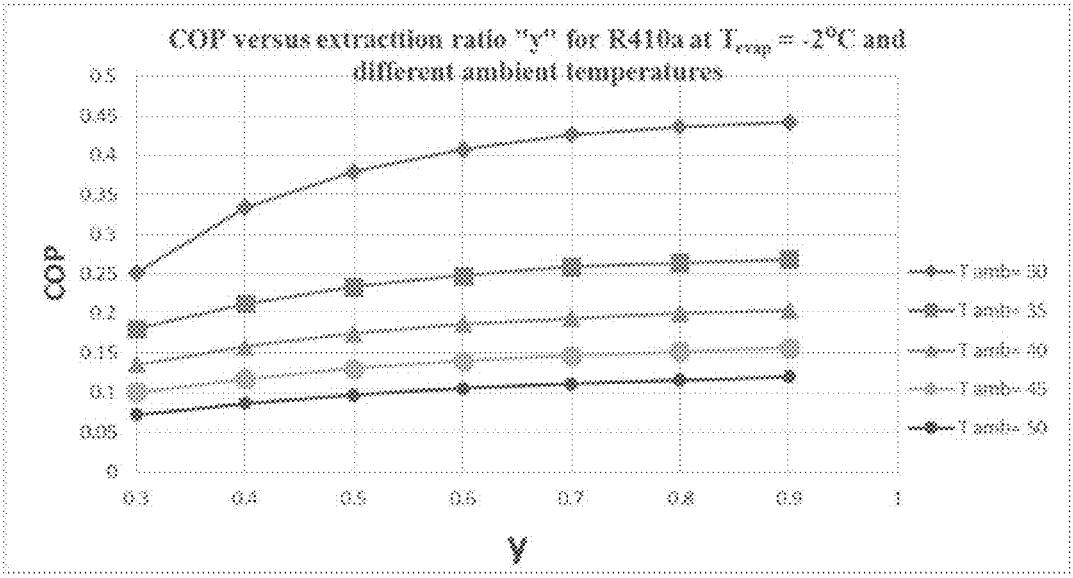
Fig. 12C COP versus the extraction ratio (y) for R410a at Tevap= −2℃ and different ambient temperatures
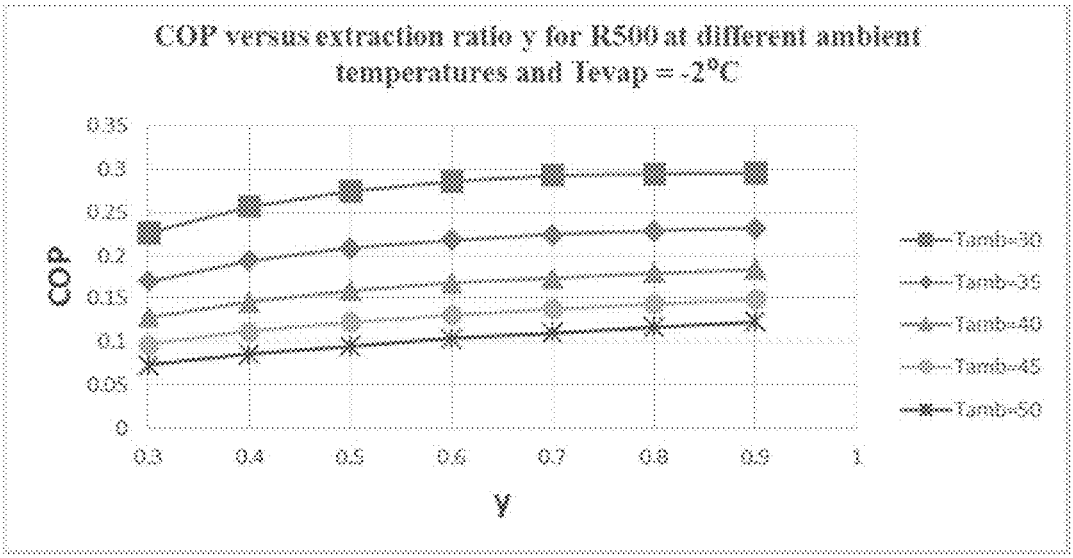
Fig. 12D COP versus the extraction ratio (y) for R500 at Tevap= −2℃ and different ambient temperatures

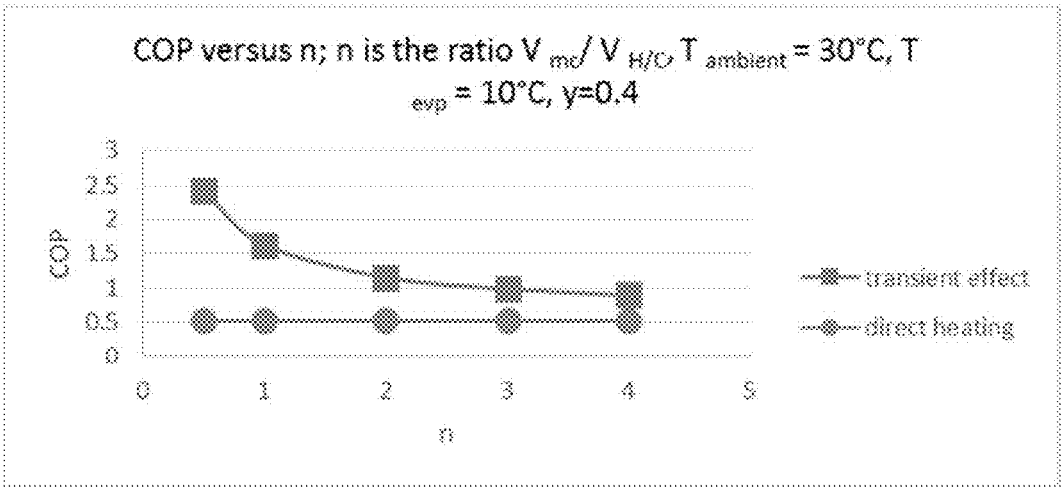
Fig. 13A COP versus n for R410a (50% R-125, 50% R-32), Tambient = 30°C, T evp = 10°C, y=0.4
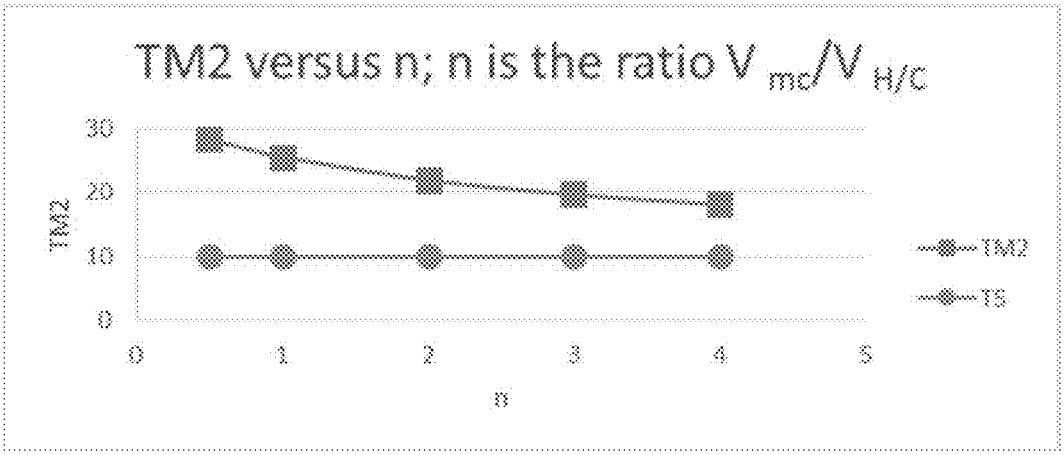
Fig. 13B TM2 versus n for R410a (50% R-125, 50% R-32), Tambient = 30°C, T evp = 10°C, y=0.4

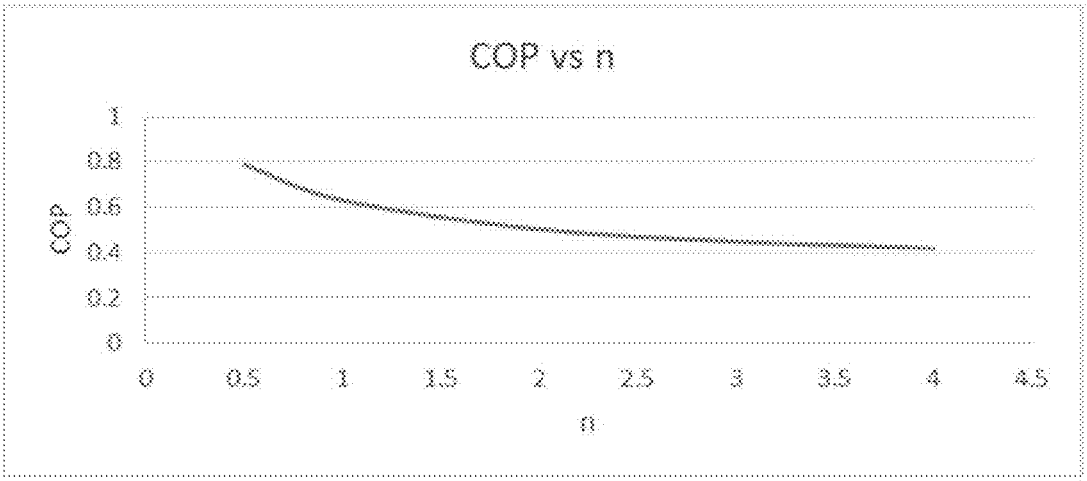
Fig. 14A COP versus n for R410a, T ambient = 40°C, T evaporator = 10°C, y=0.4
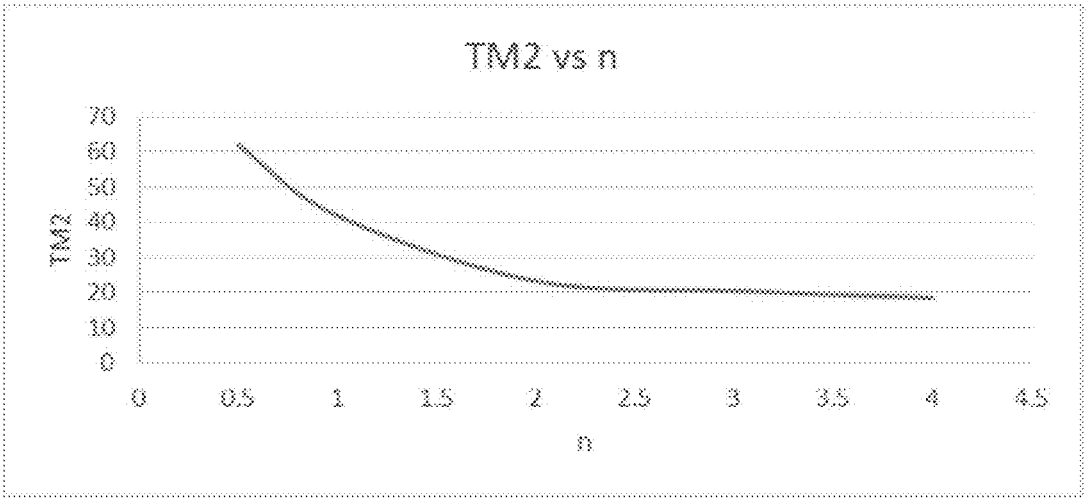
Fig. 14B TM2 versus n for R410a, T ambient = 40°C, T evaporator = 10°C, y=0.4

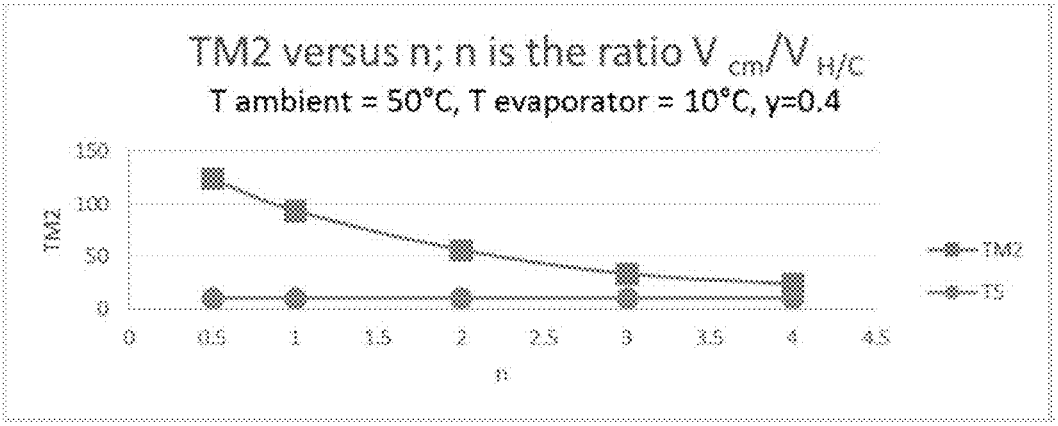
Fig. 15A COP versus n for R410a, T ambient = 50°C, T evaporator = 10°C, y=0.4
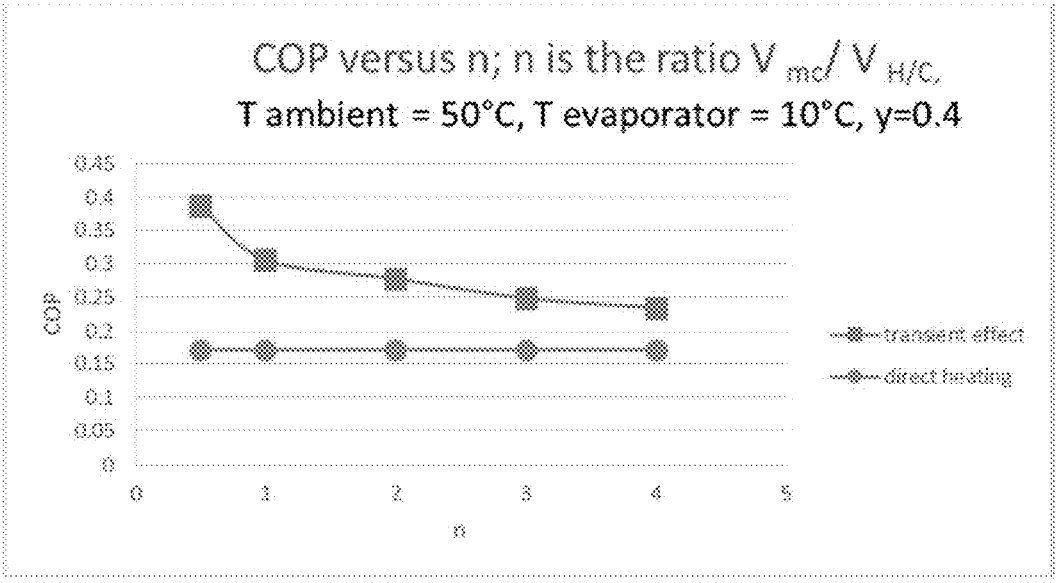
Fig. 15B TM2 versus n for R410a, T ambient = 50°C, T evaporator = 10°C, y=0.4

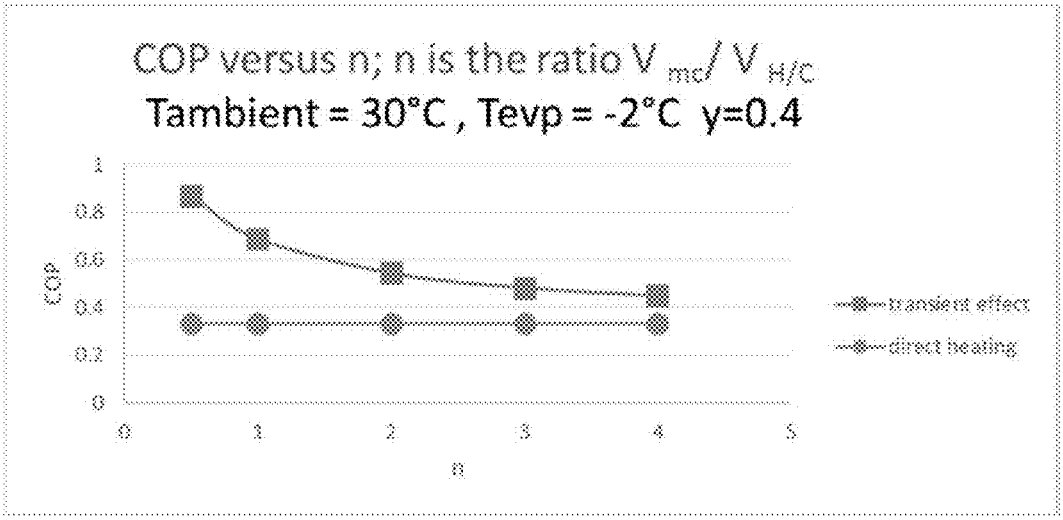
Fig. 16A COP versus n for R410a, T ambient = 30°C, T evp = –2°C, y=0.4
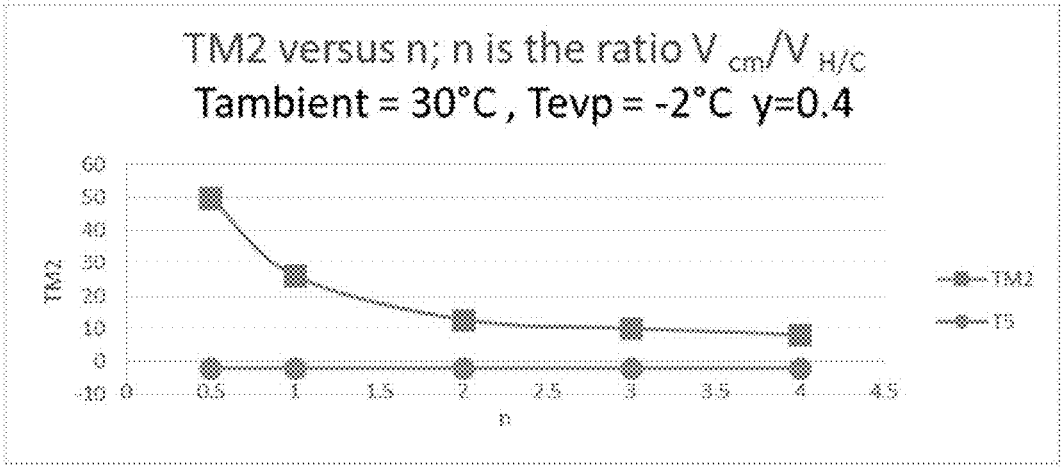
Fig. 16B TM2 versus n for R410a, T ambient = 30°C, T evp = –2°C, y=0.4

SOLAR DRIVEN REFRIGERATION SYSTEM

CROSS-REFERENCE TO RELATED APPLICATIONS

The present application is a continuation application of Ser. No. 15/096,909, now allowed.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Most solar driven refrigeration systems currently use sorption (liquid-vapor absorption or solid-vapor adsorption) techniques with some storage-facilities (heat storage, cold storage, refrigerant storage, or combination of them) to continue the refrigeration process during nights and periods of low solar insolation. Most of the well-known classical refrigerants are not suitable for such solar/waste-heat driven sorption machines. Moreover, such systems are still bulky and expensive compared to the commonly used vapor-compression refrigeration system.

Vapor-compression refrigeration systems use electrically driven compressors. Some solar-driven absorption systems employ circulating pumps, thus need electronic power supplies, and are not autonomous. Constant-volume heating technology can be used to avoid usage of the circulating pumps as well as the compressors.

SUMMARY

Aspects of the disclosure provide a refrigeration system. The refrigeration system includes (i) a condenser that receives a compressed refrigerant, and condenses the compressed refrigerant to produce a refrigerant condensate, (ii) a storage tank that stores the refrigerant condensate, (iii) an evaporator that receives a first portion of the refrigerant condensate from the storage tank, and evaporates the first portion of the refrigerant condensate to produce a refrigerant vapor, (iv) a mixing chamber that receives the refrigerant vapor from the evaporator, and a second portion of the refrigerant condensate from the storage tank, and produce a refrigerant mixture of the refrigerant vapor and the second portion of the refrigerant condensate, (v) a first refrigerant compressor between the mixing chamber and condenser, having a constant volume, and capable of operating in a heater mode or a cooler mode, the first refrigerant compressor receiving the refrigerant mixture from the mixing chamber, and compressing the refrigerant mixture to produce the compressed refrigerant using thermal energy, (vi) a second refrigerant compressor in parallel with the first refrigerant compressor between the mixing chamber and condenser, having a constant volume, and capable of operating in a heater mode or a cooler mode, the second refrigerant compressor receiving the refrigerant mixture from the mixing chamber and compressing the refrigerant mixture to produce the compressed refrigerant using thermal energy, and (vii) one or more flow control valves between the mixing chamber and the first and second refrigerant compressors that cause the first refrigerant compressor and the second refrigerant compressor to be disconnected from or connected with the mixing chamber at the same time or at different time.

In an embodiment, the storage tank controls a proportion of the first portion of the refrigerant condensate to the second portion of the refrigerant condensate according to a preconfigured extraction ratio.

In an embodiment, the first refrigerant compressor and the second refrigerant compressor operates according to the following steps: (i) the first refrigerant compressor heats a first refrigerant contained in it to produce a compressed refrigerant, and the second refrigerant compressor cools a second refrigerant contained in it; (ii) the first refrigerant compressor feeds the compressed refrigerant to the condenser, and the second refrigerant compressor is connected to the mixing chamber; (iii) the first refrigerant compressor is connected to the mixing chamber while the second refrigerant compressor keeps being connected to the mixing chamber; (iv) the first and second refrigerant compressors are disconnected from the mixing chamber; (v) the first refrigerant compressor cools a third refrigerant contained in it, and the second refrigerant compressor heats a fourth refrigerant contained in it to produce a compressed refrigerant.

In an example, a volume ratio of volume of the mixing chamber to volume of the first or second refrigerant compressor is smaller than 1. In another example, the thermal energy is solar energy generated from a flat-plate solar collector. In a further example, the one or more flow control valves include a 4-port 2-position directional control valve, and two 2-port 2-position directional control valves.

In an embodiment, the refrigeration system further includes a directional control valve between the evaporator and the mixing chamber that is closed when the first or the second refrigeration compressor is connected to the mixing chamber. In another embodiment, the refrigeration system further includes a pressure control valve between the condenser and one of the first and the second refrigerant compressors. In a further embodiment, the refrigeration system further includes a first throttle valve between the storage tank and the evaporator, and a second throttle valve between the storage tank and the mixing chamber. In an example, the refrigerant is one of R410a, R500, R134a, and R717.

Aspects of the disclosure provide a method for thermal-compression refrigeration. The method includes condensing, at a condenser, a compressed refrigerant to produce a refrigerant condensate, storing, at a storage tank, the refrigerant condensate, receiving, at an evaporator, a first portion of the refrigerant condensate from the storage tank, evaporating, at the evaporator, the first portion of the refrigerant condensate to produce a refrigerant vapor, receiving, at a mixing chamber, the refrigerant vapor, receiving, at the mixing chamber, a second portion of the refrigerant condensate from the storage tank, mixing, at the mixing chamber, the refrigerant vapor and the second portion of the refrigerant condensate to produce a refrigerant mixture, and compressing the refrigerant mixture to produce the compressed refrigerant using thermal energy.

BRIEF DESCRIPTION OF THE DRAWINGS

Various embodiments of this disclosure that are proposed as examples will be described in detail with reference to the following figures, wherein like numerals reference like elements, and wherein:

FIG. 1 shows a refrigeration system according to an embodiment of the disclosure;

FIG. 2 shows a process for thermal-compression refrigeration according to an embodiment of the disclosure;

FIG. 3 shows a process for compressing the refrigerant mixture to produce a compressed refrigerant according to an embodiment of the disclosure;

FIG. 5A shows a typical P-V diagram for the proposed refrigeration cycle including two unsteady mixing processes (M1 and M2);

FIG. 5B shows a typical T-V diagram for the proposed refrigeration cycle including two unsteady mixing processes (M1 and M2);

FIG. 6A shows a schematic diagram for the first unsteady mixing process;

FIG. 6B shows a schematic diagram for the second unsteady mixing process;

FIG. 8C shows maximum pressure (condenser pressure) versus the ambient temperature for four refrigerants;

FIG. 10A shows maximum temperature versus the extraction ratio (y) for R410a at Tevap=10° C. and different ambient temperatures;

FIG. 10B shows maximum temperature versus the extraction ratio (y) for R500 at Tevap=10° C. and different ambient temperatures;

FIG. 10C shows COP versus the extraction ratio (y) for R410a at T evap=10° C. and different ambient temperatures;

FIG. 10D shows COP versus the extraction ratio (y) for R500 at Tevap=10° C. and different ambient temperatures;

FIG. 12A shows maximum temperature versus the extraction ratio (y) for R410a at Tevap=−2° C. and different ambient temperatures;

FIG. 12B shows maximum temperature versus the extraction ratio (y) for R500 at Tevap=−2° C. and different ambient temperatures;

FIG. 12C shows COP versus the extraction ratio (y) for R410a at Tevap=−2° C. and different ambient temperatures;

FIG. 12D shows COP versus the extraction ratio (y) for R500 at Tevap=−2° C. and different ambient temperatures;

FIG. 13A shows COP versus n for R410a (50% R-125, 50% R-32), Tambient=30° C., T evap=10° C., y=0.4 (y represents extraction ratio);

FIG. 13B shows $T_{M2}$ (temperature of the refrigerant mixture after mixing process #2) versus n (ratio between the volume of the mixing chamber and the volume of the heater/cooler volume) for R410a (50% R-125, 50% R-32), Tambient=30° C., T evp=10° C., y=0.4;

FIG. 14A shows COP versus n for R410a, T ambient=40° C., T evap=10° C., y=0.4;

FIG. 14B shows $T_{M2}$ versus n for R410a, T ambient=40° C., T evap=10° C., y=0.4;

FIG. 15A shows COP versus n for R410a, T ambient=50° C., T evap=10° C., y=0.4;

FIG. 15B shows $T_{M2}$ versus n for R410a, T ambient=50° C., T evap=10° C., y=0.4;

FIG. 16A shows COP versus n for R410a, T ambient=30° C., T evap=−2° C., y=0.4; and FIG. 16B shows $T_{M2}$ versus n for R410a, T ambient=30° C., T evap=−2° C., y=0.4.

DETAILED DESCRIPTION OF EMBODIMENTS

Figure 4A:
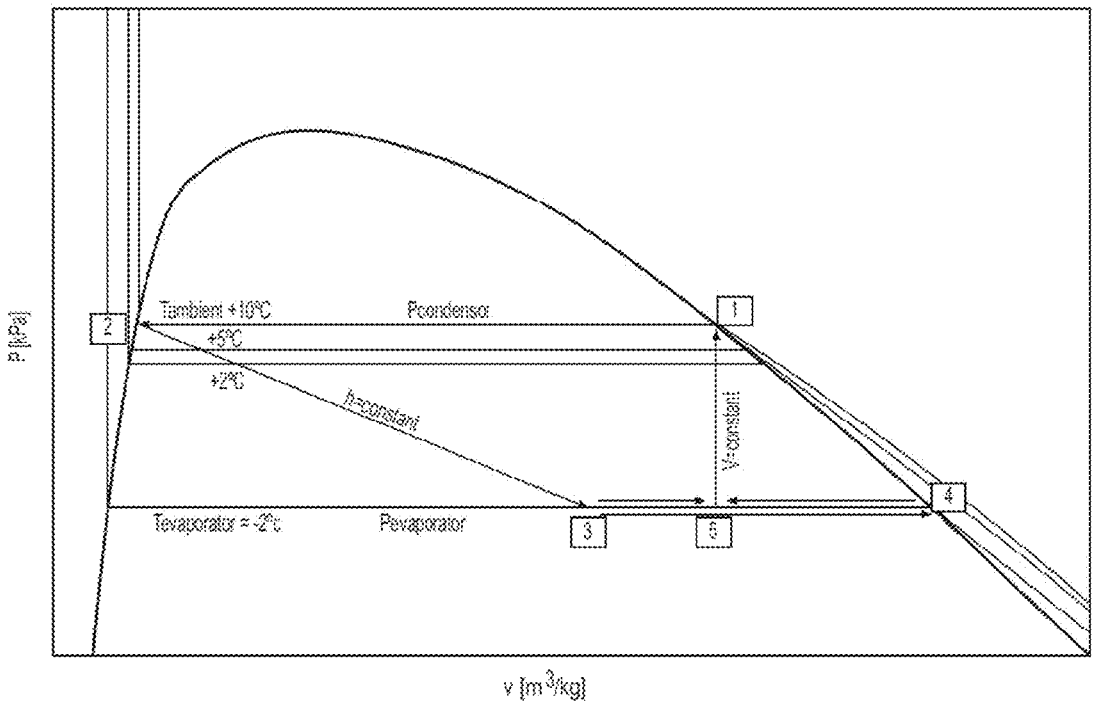
FIG. 4A shows a P-V diagram of a proposed refrigeration cycle that just gives saturated vapor at exit from a thermal compressor and neglects transient intermittent processes within the cycle.

Aspects of the disclosure provide a thermally driven refrigeration system in an embodiment. The system uses constant-volume heating technology, and can be an alternative to an absorption system. The system is less bulky, has no moving (rotary and/or reciprocating) pumps, can be of lower initial cost, and can possess a higher coefficient of performance (COP) when compared with sorption systems. In addition, the system uses lower grade and cheaper thermal energy and has no moving (rotary and/or reciprocating) compressors when compared with vapor-compression systems. The system can, with a thermal and/or refrigerant storage facility, continue refrigeration during night when it is solar-operated.

In an example, the system can use well known refrigerants such as R410a, R500, R134a and R717. In one example, the system is suitable for refrigeration applications that require cold temperatures not lower than −2° C., such as commercial refrigerated cabinets for displaying certain types of food products, and other similar applications. In another example, the system is suitable for summer air conditioners in ambient temperatures up to 50° C. when R410a or R500 is used as working refrigerant, and a low temperature solar collector is employed.

FIG. 1 shows a refrigeration system 100 according to an embodiment of the disclosure. The system 100 includes a condenser 01, a refrigerant-storage tank (RST) 02, an evaporator 05, a mixing chamber (MC) 07, a first throttling valve (THV) 04 between the RST 02 and the evaporator 05, a second throttling valve (THV) 03 between the RST 02 and the MC 07, a first two-port two-position solenoid-operated directional control valve (2/2 DCV) 06 between the evaporator 05 and the MC 07, a first heater/cooler (H1/C1) 11, a second heater/cooler (C2/H2) 12 in parallel with the first H1/C1, a four-port two-position solenoid operated directional control valve (4/2 DCV) 10 at entry/exit of H1/C1 11 and exit/entry of C2/H2 12, a second 2/2 DCV 08 between the MC 07 and the 4/2 DCV 10 in the feed-line to 4/2 DCV 10, a third 2/2 DCV 09 between the MC 07 and the 4/2 DCV 10 in the discharge line from 4/2 DCV 10, a first pressure control (relief) valve (PCV) 13 between H1/C1 11 and the condenser 01, a second pressure control (relief) valve (PCV) 14 between C2/H2 12 and the condenser 01, and a plurality of check valves 15-20. Those components are coupled together as shown in FIG. 1.

As shown in FIG. 1, and in other embodiments of the invention, several components of the system may be commercially available and well known to those skilled in the art. The components may also be directly connected to one another, for example, by connecting pipes, without intervening components. Also, valves may be disposed in a variety of ways, for example, between portions of connecting pipes, or for example, integrally to other system components. As used herein, the term "fluid" refers to a liquid, a gas or a mixture thereof.

The condenser 01 receives a compressed refrigerant from the H1/C1 11 or C2/H2 12, and condenses the compressed refrigerant to produce a refrigerant condensate. Non-limiting examples of a refrigerant include ammonia, a fluorocarbon, a chlorofluorocarbon, and a mixture thereof. Preferred refrigerants include R410a, a zeotropic blend of 50 vol % difluoromethane and 50 vol % pentafluoroethane, and R500, an azeotropic blend of 73.8 vol % dichlorodifluoromethane and 26.2 vol % 1,1-difluoroethane. The refrigerant R410a has a critical temperature of 72.8° C. and a critical pressure of 4.86 MPa. The refrigerant R500 has a critical temperature of 102.1° C. and a critical pressure of 4.17 MPa. As used herein, the term "critical temperature" of the refrigerant refers the temperature at and above which vapor of the refrigerant cannot be liquefied, no matter how much pressure is applied. As used herein, the term "critical pressure" of the refrigerant refers the pressure to liquefy a refrigerant vapor at its critical temperature.

In an example, the condenser 01 has a working temperature that is up to 20° C. above the ambient temperature, preferably up to 15° C., more preferably up to 10° C., preferably from 2 to 8° C. above the ambient temperature, in order to have a driving temperature difference in the condenser 01 for the cooling heat transfer process during the condensation process. The ambient temperature ranges from 30-50° C., hence the condenser working temperature is preferably 40-60° C. In an example, ambient air is used for cooling the condenser 01. In another example, cooling water is used to draw heat out of the condenser 01. Temperature of the cooling water is at least 3-5° C. less than the condenser temperature. In addition, the temperature of the condensate exiting the condenser is selected to be up to 15° C. above the temperature of the evaporator, preferably up to 12° C., more preferably up to 10° C., preferably from 2 to 8° C. above the temperature of the evaporator.

In selected embodiments, evaporative condensers might be employed. The condenser 01 may be constructed of a material such as metal, plastic, or glass, for example, that can withstand the temperatures and pressures associated with condensing refrigerant vapor and that is compatible with the particular refrigerant used in the system. Preferably, the condenser 01 comprises copper.

The condenser 01 can act as a source of refrigerant for the RST 02, preferably by gravity feed, with 1-20 kg of condensate, preferably 1-10 kg, more preferably 1-5 kg of condensate, to satisfy an instantaneous cooling load.

The RST 02 receives the refrigerant condensate from the condenser 01, and stores the refrigerant condensate. The RST 02 may be constructed of a material, such as metal, plastic, or glass, for example, that can withstand the temperatures and pressures associated with storing liquid refrigerant and that is compatible with the particular refrigerant used in the system. In an embodiment, the RST 02 has two outlets or a single outlet that branches into two lines to feed the condensate into the evaporator 05 and the MC 07. In another embodiment, where the system has no mixing chamber MC07, the RST 02 has a single outlet.

In a preferred embodiment, the RST 02 has two outlets. Two streams of the refrigerant leave the RST 02. While the condensate is continuously extracted from the RST 02A, a first portion of the refrigerant condensate is extracted from the RST into the evaporator 05 after being throttled in the THV 04, and a second portion of the refrigerant condensate is extracted from the RST 02 into the MC 07 after being throttled in THV 03. Non-limiting examples of throttling valves 03 and 04 include thermostatic expansion valves and float valves.

According to an aspect of the disclosure, a proportion of the first portion of the refrigerant condensate to the second portion of the refrigerant condensate is controlled to be a preconfigured extraction ratio while the condensate is continuously extracted from the RST 02A. The extraction ratio, represented by letter "y", refers to a mass fraction of condensate going to the evaporator 05 per unit mass of condensate feeding the RST 02. In other words, the extraction ratio y is a mass fraction of the mass of the first portion relative to the total mass of the first portion and the second portion of the refrigerant condensate extracted from the RST. Thus, when there is no MC07 in the system, the extraction ratio y equals unity (y=1). However, the extraction ratio ranges from 0.3-0.9, preferably 0.3-0.7, more preferably 0.3-0.5.

In an example, the RST 02 controls the proportion of the first portion of the refrigerant condensate to the second portion of the refrigerant condensate according to the preconfigured extraction ratio. In one example, the RST 02 includes a control device. The control device can include flow meters, such as mechanical flow meters or pressure-based meters, to measure amount of condensate flowing through the two outlets. Based on the measurement and the preconfigured extraction ratio, the control device can control, for example, the throttling valves 03 and 04 to regulate the condensate of the first portion and the second portion to meet the extraction ratio configuration.

The evaporator 05 receives the first portion of the refrigerant condensate from the storage tank 02, and evaporates the first portion of the refrigerant condensate to produce a refrigerant vapor. The temperature of the evaporator 05, and hence the refrigeration temperature, ranges from −10° C. to 10° C., preferably −5° C. to 10° C., more preferably −2 to 10° C. when the temperature of air in the exterior is in a range of 30-50° C. As used herein, the term "refrigeration temperature" refers to the temperature of the cooled space in the vicinity of the evaporator 05. The evaporator 05 may be a bare-tube evaporator, plate surface evaporator or a finned evaporator in different embodiments. The evaporator 05 may be constructed of a material, such as metal, plastic, or glass, for example, that can withstand the temperatures and pressures associated with evaporating liquid refrigerant to form the refrigerant vapor and that is compatible with the particular refrigerant used in the system.

The evaporation at the evaporator 05 produces a refrigeration effect which is employed for refrigeration purposes. The evaporator 05 may be connected to a fan that blows air over the evaporator 05, and the refrigerant in the evaporator 05 absorbs heat from the air to form cooled air. The cooled air may be distributed in a building and/or a refrigerator via ducts and/or blower systems. The refrigerant fluid exits from the evaporator 05 at a rate of 0.2-0.6 kg/s, preferably 0.2-0.5 kg/s, more preferably 0.2-0.4 kg/s.

The MC 07 receives the refrigerant vapor from the evaporator 05 through the first 2/2 DCV 06, and the second portion of the refrigerant condensate from the RST 02, and produce a refrigerant mixture of the refrigerant vapor and the second portion of the refrigerant condensate. The refrigerant mixture is a saturated vapor-liquid refrigerant mixture. The refrigerant mixture has a quality, represented as x5. As used herein, "quality" refers to a vapor quality of the refrigerant mixture. Generally, a vapor quality of a vapor-liquid mixture refers to a mass fraction of the mass of the vapor to the total mass of the mixture. For example, a low quality refrigerant has a low vapor mass.

According to an aspect of the disclosure, a proper thermal compression performed at the H1/C1 11 or the C2/H2 12 needs the refrigerant mixture in the MC 07 to have a suitable quality. In addition, the quality of the refrigerant mixture in the MC 07 is determined by the extraction ration y. Accordingly, in order to have the suitable quality of the refrigerant mixture in the MC 07, the extraction ratio needs to be controlled to be a certain value or within a certain range. Based on the preconfigured extraction ratio, a suitable quality of the refrigerant mixture can be obtained. In a preferred embodiment, a low quality refrigerant with a quality of 0.1-0.5, preferably 0.2-0.45, more preferably 0.25-0.4 is achieved by mixing the aforementioned mass fractions of the first and second portions of the refrigerant liquid.

The MC 07 can have a shape of a cube, a cuboid, or preferably a cylinder. The cylindrical mixing chamber may have hemispherical ends. The MC 07 may be constructed of a material such as metal, plastic, or glass, for example, that can withstand the temperatures and pressures associated with mixing a refrigerant vapor and a refrigerant liquid. Preferably, the MC 07 is constructed from stainless steel. The MC07 is sized to accommodate 1-20 kg of refrigerant fluid (i.e. liquid and vapor), preferably 1-10 kg, more preferably 1-5 kg. The volume of the refrigerant fluid takes up 50-90% of the volume of the mixing chamber, preferably 60-80%, more preferably 70-80%.

The MC 07 may have one or multiple inlets and outlets. In a preferred embodiment, the MC 07 has a first inlet to receive the refrigerant vapor from the evaporator 05 and a second inlet to receive the refrigerant liquid from the RST 02. The first and second inlets may be oriented parallel to each other on a wall of the MC 07, and may produce streams of refrigerant liquid and/or vapor parallel to the latitude of the cylinder. Preferably, the streams entering a cylindrical mixing chamber are parallel to the longitudinal axis of the cylinder. In another embodiment, the first inlet is installed on the body of the cylindrical mixing chamber while the second inlet is installed on the top of the cylinder.

Each inlet may independently be a nozzle designed to inject the refrigerant liquid and vapor to result in turbulent mixing of the two phases in the mixing chamber. Non-limiting examples of nozzles include jet nozzles and high velocity nozzles. In a preferred embodiment, spray nozzles are used and the refrigerant liquid is sprayed in a radial direction to enable mixing with the refrigerant vapor.

In another embodiment, the refrigerant liquid is sprayed into the mixing chamber through an inlet that is oriented substantially perpendicular to the longitudinal axis of the cylinder. The refrigerant vapor is injected into the mixing chamber from an inlet installed on the top of the cylinder. In this manner the refrigerant liquid forms a vortex inside the MC 07 carried by the refrigerant vapor formed by the evaporation of the refrigerant liquid. The mixing of the refrigerant liquid and the refrigerant vapor may also be driven by a stirrer such as a mechanical stirrer or a magnetic stirrer.

In one embodiment, the MC 07 has a third inlet that connects the third 2/2 DCV 09 to the MC 07. Thus, refrigerants from the H1/C1 11 or the C2/H2 12 can be received. In addition, the MC 07 has an outlet connected to the second 2/2 DCV 08, from which the resultant refrigerant mixture exits the MC 07. The outlet may be arranged on the top of the mixing chamber. Preferably, the outlet is arranged on the body of the cylindrical mixing chamber.

The first H1/C1 11 receives the refrigerant mixture from the MC 07, and thermally compresses the refrigerant mixture to produce the compressed refrigerant. Thus, the first H1/C1 11 is also referred to as the first refrigerant compressor 11. The first refrigerant compressor 11 is located between the MC 07 and the condenser 01. During the refrigerant compression process, the first refrigerant compressor 11 uses thermal energy to heat a refrigerant contained in the refrigerant compressor 11, and keeps a constant volume. Accordingly, the first refrigerant compressor 11 is a constant volume thermal compressor. The first refrigerant compressor 11 is capable of operating in a heater mode or a cooler mode. The first refrigerant compressor 11 operates as a heater when in heater mode, and as a cooler when in cooler mode.

Similarly, the second H2/C2 12 also receives the refrigerant mixture from the MC 07, and thermally compresses the refrigerant mixture to produce the compressed refrigerant. Thus, the second H2/C2 12 is also referred to as the second refrigerant compressor 12. The second refrigerant compressor 12 is located between the MC 07 and the condenser 01 in parallel with the first refrigerant compressor 11. During the refrigerant compression process, the second refrigerant compressor 12 uses thermal energy to heat a refrigerant contained in the refrigerant compressor 12, and keeps a constant volume. Accordingly, the second refrigerant compressor 12 is also a constant volume thermal compressor. The second refrigerant compressor 12 is also capable of operating in the heater mode or the cooler mode, when the first refrigerant compressor is operating in the cooler mode or the heater mode, respectively.

The first and the second refrigerant compressor 11 and 12 have similar structure and function. The first refrigerant compressor 11 is used as an example for description of the structure and the function below.

The first refrigerant compressor 11 may be constructed of a material such as metal or glass (e.g. Pyrex), for example, that can withstand the temperatures and pressures associated with compressing refrigerant vapor and/or liquid and that is compatible with the particular refrigerant used in the system.

The first refrigerant compressor 11 is sized to accommodate 1-20 kg of refrigerant, preferably 1-10 kg, more preferably 1-5 kg at a pressure ranging from 2-30 bar, preferably 4-25 bar, more preferably 4-18 bar.

In an example, the first refrigerant compressor 11 includes a cooling coil with water as the cooling fluid flowing through the coil. When the first refrigerant compressor 11 is in cooler mode, the cooling coil starts to operate to transfer heat from the first refrigerant compressor 11. In other examples, instead of the cooling coil, other type of heat exchanger are used, including shell and tube heat exchangers, plate heat exchangers, plate and fin heat exchangers, and the like.

In an example, the first refrigerant compressor 11 includes a heating coil with a heating fluid flowing through the coil. When the first refrigerant compressor 11 is in heater mode, the heating coil starts to operate to transfer heat to the first refrigerant compressor 11. Similarly, in other examples, instead of the heating coil, other type of heat exchanger are used, including shell and tube heat exchangers, plate heat exchangers, plate and fin heat exchangers, and the like.

In various embodiments, the heating fluid can be heated using thermal energy from various heat sources, such as solar collectors, process vapor, hot water, furnace exhaust gases, exhaust gases of internal combustion engines, and the like. In an example, the refrigeration system 100 may continue refrigeration during nights and periods of low solar insolation (operate 24 hours a day) by incorporating a heat storage facility in the system.

In an example, a flat-plate solar collector is used. A solar collector according to an embodiment is a thermal collector, which comprises a heat exchanger, and may comprise any of various configurations of structures adapted for use with various heat sources, such as sunlight, exhaust gas, or geothermal heat, for example. A solar collector, according to an embodiment, converts energy from sunlight into thermal energy that can be used to perform work on a fluid. In various embodiments, a solar collector may have one or more of various geometries including a flat plate, arc, or compound parabolic curve, for example. In other embodiments, a solar collector may exploit optical or other properties of sunlight, including absorption, reflection, or refraction, for example, to harness useable energy from sunlight. Preferably the solar collector collects solar energy in the form of heat rather than in the form of electricity or electrical potential. For example, in an embodiment of the invention the solar collector is not a photovoltaic cell.

In an embodiment, solar energy can be the only heat source and no auxiliary heat source is necessary. In another embodiment, no additional thermal store is used anywhere in a thermal circuit comprising one or more thermal collectors and a generator. A solar collector according to an embodiment may have a solar collector fluid, for example water or another fluid suitable for operation as a medium for heat exchange, such as saline, antifreeze, or oil. A solar collector according to an embodiment may likewise be used to heat a fluid circulating in and out of the solar collector, for example water, or another fluid suitable for operation as a medium for heat exchange, such as saline, antifreeze, or oil.

The pressure control valves (PCVs) 13 and 14 are located between the condenser 01 and the first and the second refrigerant compressors 11 and 12. The PCVs 13 and 14 are set to open when pressure in the refrigerant compressor 11 or 12 reaches pressure of the condenser 01. When the set pressure is exceeded, the PCV 13 or 14 is open, and the compressed refrigerant is released from the refrigerant compressor 11 or 12 to the condenser 01. Non-limiting examples of a pressure relief valve include an ASME I valve, an ASME VIII valve, a low lift safety valve, a full lift safety valve, a full bore safety valve, a balanced safety relief valve, a pilot-operated pressure relief valve, and a power-actuated pressure relief valve. Preferably, a conventional spring-loaded pressure relief valve is employed.

The 4/2 DCV 10 is installed between the first and second refrigerant compressor 11 and 12, and the second and third 2/2 DCV 08 and 09. When the 4/2 DCV 10 is on the first position corresponding to the parallel arrow envelope mode, the first refrigerant compressor 11 is connected to the discharging line from the MC 07, and refrigerant can be received into the first compressor 11 from the MC 07. At the same time, the second refrigerant compressor 12 is connected to the feeding line to the MC 07, and refrigerant can be discharged from the second compressor 12 to the MC 07. While, when the 4/2 DCV 10 is on the second position corresponding to the cross over envelope mode, the first refrigerant compressor 11 is connected to the feeding line to the MC 07, and refrigerant can be discharged from the first compressor 11 to the MC 07. At the same time, the second refrigerant compressor 12 is connected to the discharging line from the MC 07, and refrigerant can be received to the second compressor 12 from the MC 07.

The first, second, and third 2/2 DCV 06, 08, and 09 each can be in an open position permitting refrigerant flowing through, or a closed position blocking the refrigerant. The plurality check valves 19-20 regulate flow of the refrigerant in the refrigerant system 100, and permit the refrigerant to flow in one direction only. Non-limiting examples of a check valve include a ball check valve, a diaphragm check valve, a swing check valve, a stop-check valve, a lift-check valve, an in-line check valve, a duckbill valve, a pneumatic non-return valve, and the like.

At least one of the aforementioned elements of the refrigeration system 100 may be installed in cooling devices, which include air conditioners and refrigerators, to provide a refrigeration effect. For example, an air conditioner may house the evaporator 05, condenser 01, refrigerant compressors 11 and 12, MC 07 and RST 02, while a solar collector is installed outside the building. In an embodiment employing a water-cooled condenser, the condenser is located outside of the air conditioner.

FIG. 2 shows a process 200 for thermal-compression refrigeration according to an embodiment of the disclosure. The process 200 starts at S201, and proceeds to S210.

At S210, a compressed refrigerant is condensed at a condenser to produce a refrigerant condensate.

At S220, the refrigerant condensate is stored at a storage tank.

At S230, a first portion of the refrigerant condensate is received at an evaporator from the storage tank according to a preconfigured extraction ratio.

At S240, the first portion of the refrigerant condensate is evaporated at the evaporator to produce a refrigerant vapor.

At S250, the refrigerant vapor is received at a mixing chamber.

At S260, a second portion of the refrigerant condensate is received at the mixing chamber from the storage tank according to the preconfigured extraction ratio. In an example, the step S260 are performed parallel to the steps S230-S250.

At S270, the refrigerant vapor and the second portion of the refrigerant condensate are mixed at the mixing chamber to produce a refrigerant mixture.

At S280, the refrigerant mixture is compressed to produce the compressed refrigerant at a thermal compressor. In an example, constant-volume heating technology is used. The process 200 proceeds to S299, and terminates at S299.

FIG. 3 shows a process 300 for compressing the refrigerant mixture to produce a compressed refrigerant at a thermal compressor including a first refrigerant compressor and a second refrigerant compressor according to an embodiment of the disclosure. The refrigeration system 100 in FIG. 1 is used as an example to describe the process 300. As shown in FIG. 1, the thermal compressor includes the first refrigerant compressor 11 and the second refrigerant compressor 12 as shown in FIG. 1. The process 300 starts at S301, and proceeds to S310.

At S310, a first refrigerant contained in the first refrigerant compressor 11 is heated to produce a first compressed refrigerant, and at the same time, a second refrigerant contained in the second refrigerant compressor 12 is cooled.

In FIG. 1 example, to achieve continuity of operation, the refrigeration system 100 has at least two parallel constant-volume heaters/coolers 11 and 12. When one of these two constant-volume heaters/coolers 11 and 12 is heating the refrigerant by means of solar/waste-heat thermal energy (for the sake of feeding the resultant thermally-compressed vapor into the condenser 01), the other one is cooling the remained refrigerant inside it. In this mode of operation, the first refrigerant compressor 11 is in heater mode, while the second refrigerant compressor is in cooler mode. The 4/2 DCV 10 is on the parallel arrow envelope mode of operation. Moreover, the valves 08, 09, 13, and 14 are closed while valve 06 is open.

The cooling of the second refrigerant compressor 12 is either by ambient air or by cooling water in order to reduce the remained refrigerant's pressure to an intermediate value between the condenser 01 and evaporator 05 pressures. This intermediate pressure theoretically corresponds to the saturation value at the ambient temperature. However, in an example for investigation, in order to have a driving temperature difference for the heat transfer process during the cooling process, this pressure is set to be the saturation pressure at the ambient temperature plus 2° C. This cooling process makes the refrigerant compressor 12 ready to be charged with a new charge of refrigerant vapor-liquid mixture coming from the MC 07.

At S320, the first compressed refrigerant is fed to the condenser 01 from the first refrigerant compressor 11, and at the same time the second refrigerant compressor 12 is connected to the MC 07.

In FIG. 1 example, each of the above two constant-volume heaters/coolers 11 and 12 is equipped at its exit with the pressure relief valve 13 and 14 that has a setting value equal to the condenser 01 pressure. It is worth mentioning here that the condenser 01 working temperature/pressure is explicitly dependent on the ambient temperature (it has been selected in the example for investigation to be 10° C. above the ambient temperature in order to have a driving temperature difference in the condenser 01 for the cooling heat transfer process by ambient air during the condensation process).

When the pressure, for example, in the first refrigerant compressor 11 reaches the condenser pressure, the PCV 13 and the 2/2 DCV 09 are opened, the 2/2 DCV 05 is closed, the cooling operation of the second refrigerant compressor 12 is stopped and other valves 14 and 08 remain closed. Under these circumstances the first refrigerant compressor 11 feeds the condenser 01 with the thermally compressed refrigerant and the second refrigerant compressor 12 is connected to the MC 07.

At S330, the first refrigerant compressor 11 is connected to the MC 07, and at the same time, the second refrigerant compressor 12 keeps connection to the MC 07.

At this stage, 4/2 DCV 10 is placed on its cross-over envelope mode of operation, all heating and cooling operations are stopped, the two PCVs 13 and 14 together with 2/2 DCV 06 are closed while DCVs 08 and 09 are opened. Thus the relatively hot first refrigerant compressor 11 with a relatively higher pressure will be discharging into MC 07, and the cold refrigerant compressor 12 will be charged from MC 07.

The two constant-volume heaters/coolers 11 and 12 exchange their modes of operation by means of the 4/2 DCV 10, located upstream of the two refrigerant compressors 11 and 12. At the entrance of the 4/2 DCV, the 2/2 DCV 08 is normally closed to prevent the high pressure vapor from going back into the MC 07 on the low-pressure side of the system. Similarly, at the exit of the 4/2 DCV 10, the 2/2 DCV 09 is normally closed to prevent the high pressure vapor from going back into the MC 07 on the low-pressure side of the system when the second refrigerant compressor 12 is in cooling operation.

The two 2/2 DCVs 08 and 09 together with the two THVs 03 and 04 divide the refrigeration system 100 into two segments: a high-pressure side in which the first or the second refrigerant compressors 11 and 12 when in heater mode, the condenser 01, and the RST 02 exist, and a low-pressure side in which the first or the second refrigerant compressors 11 and 12 when in cooler mode, the evaporator 01 and the MC 07 exist.

It is noteworthy that the evaporator 05 low pressure value is mainly dependent on the required cooling effect temperature as well as the refrigerant used in the system. In the thermodynamic analysis conducted in the example for investigation, two evaporator temperatures have been selected to meet requirements of certain cooling applications, namely, −2° C. and 10° C. The first temperature (−2° C.) can meet light freezing or cold refrigeration applications for preservation of many fruits and vegetables (such as apples, plums, cherries, grapes, peaches, apricots, broccoli, green peas, sweet corn, carrot, mushrooms, onions, cabbage, etc.), and the latter temperature is more than suitable for air conditioning applications.

In the example for investigation, the condensate comes out of the condenser 01 as subcooled (compressed) liquid that is 5° C. above the ambient air (cooling medium) temperature.

At S340, a third refrigerant contained in the first refrigerant compressor 11 is cooled, and at the same time, a fourth refrigerant contained in the second refrigerant compressor 12 is heated to produce a second compressed refrigerant.

In FIG. 1 example, while keeping the 4/2 DCV 10 on its cross-over mode of operation, opening the 2/2 DCV 06 and keeping all other valves 08, 09, 13 and 14 closed, the second refrigerant compressor 12 starts to operate in heater mode, and heats and compresses the refrigerant in a constant volume process. At the same time, the first refrigerant compressor 11 starts to operate in cooler mode, and cools and reduces the refrigerant pressure in a constant volume process.

At S350, the first refrigerant compressor 11 is connected to the MC 07, and at the same time, the second compressed refrigerant is fed to the condenser 01 from the second refrigerant compressor 12.

In FIG. 1 example, the 4/2 DCV is kept as is. The pressure in the second refrigerant compressor 12 reaches the condenser 10 pressure, and PCV 14 is opened. The second refrigerant compressor 12 keeps operating in heater mode. The 2/2 DCV 09 is opened. The first refrigerant compressor 11 stops the cooling operation. The 2/2 DCV 06 is closed. Thus, the second refrigerant compressor feeds the condenser 01, and the first refrigerant compressor is connected to MC 07.

At S360, the second refrigerant compressor 12 is connected to the MC 07, and at the same time, the first refrigerant compressor 11 keeps being connected to the MC 07.

In FIG. 1 example, at this stage, the 4/2 DCV 10 returns to its parallel arrow mode of operation. All heating and cooling operations are stopped. The two PCVs 13 and 14 together with 2/2 DCV 06 are closed while valves 08 and 09 are opened. Thus, the relatively hot second refrigerant compressor 12 with a relatively higher pressure discharges into MC 07, and the cold first refrigerant compressor 11 with a relatively lower pressure is charged from MC 07.

The process 300 proceeds to S399, and terminates at S399.

While for purposes of simplicity of explanation, the processes 200 and 300 are shown and described as a series of steps, it is to be understood that, in various embodiments, the steps may occur in different orders and/or concurrently with other steps from what is described above. Moreover, not all illustrated steps may be required to implement the process described above.

It is important to mention here that the mechanical compression that is used in vapor compression systems usually requires saturated or superheated vapor at the beginning of the compression process to avoid harming the blades of the compressor. However, according to an aspect of the disclosure, the constant-volume thermal compression of the refrigeration system 100 requires a saturated vapor-liquid mixture (vapor with a quality x5) at the beginning of the compression process rather than being a saturated vapor, as it comes out of the evaporator 05. Such a vapor with a quality x5 guarantees reasonable maximum working temperature, and volume of the constant volume heaters (the refrigerant compressor 11 and 12 in FIG. 1 example). Theoretically speaking, the minimum possible maximum working temperature is the saturation temperature corresponding to the condenser 01 pressure.

According to an aspect of the disclosure, the extraction ration y is the main influential parameter in designing the proposed system. The value of y defines the value of the refrigerant vapor quality at the beginning of the compression process (x5). The value of x5 defines the value of the temperature at the end of the compression process (the maximum temperature in the thermodynamic cycle; which corresponds to the maximum allowable working temperature for the system under consideration. The value of x5 defines also the required volume of each of the heaters/coolers (H1/C1 and H2/C2) 11 and 12.

Figure 4B:
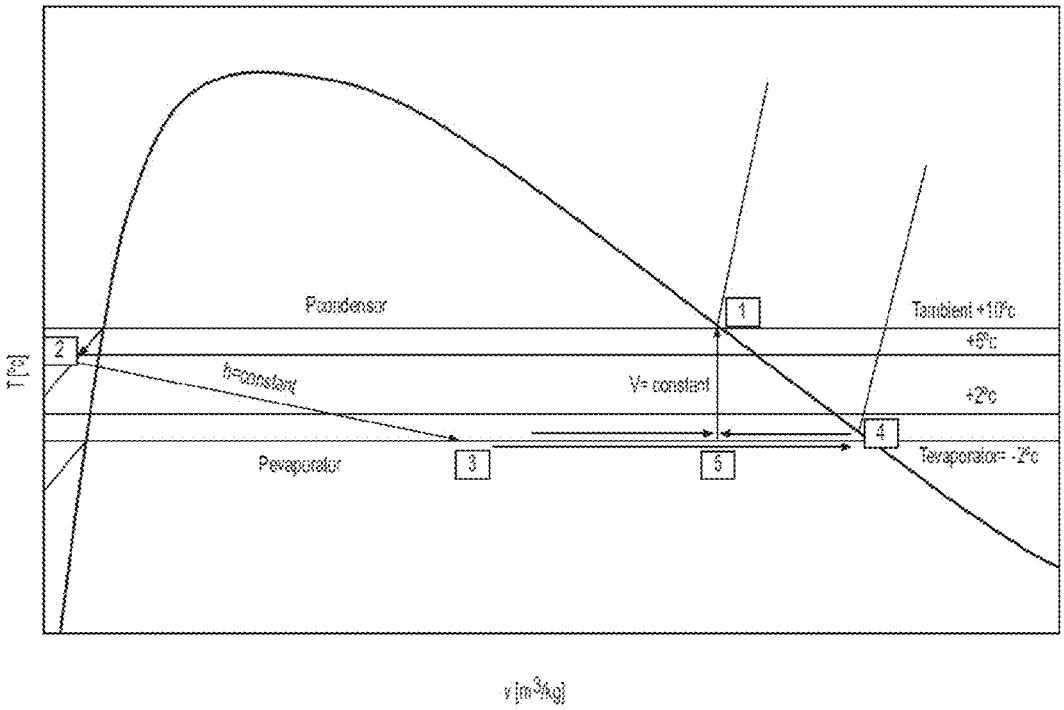
FIG. 4B shows a T-V diagram of the proposed refrigeration cycle that just gives saturated vapor at exit from a thermal compressor and neglects transient intermittent processes within the cycle.

FIGS. 4A and 4B show, respectively, the schematic p-v and T-v diagrams of the proposed refrigeration cycle (process 200) with x5 that just gives saturated vapor at exit from the thermal compressor (the first and the second refrigerant compressor 11 and 12) and neglects the transient intermittent processes (process 300) in the cycle. In these diagrams, with saturated vapor refrigerant at exit from the constant volume heater (the first or the second refrigerant compressor 11 and 12), the system is operating at its minimum possible maximum allowable working temperature that might best suit low-temperature solar collector field/waste heat as a driver to the proposed novel system. This is also guarantees reasonable maximum working temperature and volume of the constant volume heaters.

It is noted that having a value of x5 larger than that indicated in these schematic diagrams would make the vapor at exit from the thermal compressor in a superheated state and the system maximum working temperature might not suit low-temperature solar collector field/waste heat as a driver to the proposed novel system. In other words, increasing the value of x5 larger than that indicated in these schematic diagrams increases the temperature of the solar collector field/waste-heat source that is required to drive the proposed novel system.

FIGS. 5A and 5B give typical P-v and T-v diagrams for the complete proposed system's cycle including the two unsteady mixing processes (process 300). The thermodynamic cycle, shown in FIGS. 5A and 5B, comprises the following eight processes. First, heat rejection by the high-pressure high-temperature refrigerant in the condenser 01 to the ambient air, either directly or through a cooling water coil, as indicated by process 1-2 in the diagram, at the constant condenser-pressure. Second, throttling the refrigerant condensate in the first THV 04 as well as in the second THV 03 as given in the diagram by the constant enthalpy process 2-3. Third, producing the refrigeration (cooling) effect by heat addition to the refrigerant in the evaporator 05. This process occurs at the constant evaporator-pressure as indicated by the process 3-4 in the diagram.

Fourth, mixing the produced saturated refrigerant vapor coming out of the evaporator 05 (state 4) with the throttled remained condensate coming from the RST 02 in the MC 07 as given in the diagram by both lines 3-5 and 4-5. Fifth, cooling the refrigerant in C2/H2 12 from state point 1 to state point 6. Sixth, mixing process #1 when 2/2 DCV 09 opens and the refrigerant at state point 5 in the mixing chamber MC 07 mixes with the refrigerant at state point 6 in C2/H2 12; the resulting state is M1. Seventh, mixing process #2 when 2/2 DCV 09 opens and the refrigerant at state point 5 in the mixing chamber MC 07 mixes with the refrigerant at state point 6 in C2/H2 12; the resulting state is M2. Eighth, completing the thermodynamic cycle by thermal compression in the heater (using solar energy or waste heat) of the resultant refrigerant saturated vapor-liquid mixture at state point M2 in H1/C1 11 as given in the diagram by the constant volume process M2-1.

The remaining part of this detailed description includes the following three sections: Section 1: Governing equations of the thermodynamic analysis of the proposed refrigeration system; Section 2: Analysis of transient process; Section 3: Simulation results and discussion of the example for investigation. In the description below, the refrigeration system 100 and its components are used as the exemplary refrigeration system and corresponding components, and numerals referencing the refrigeration system and corresponding components are omitted for brevity.

Section 1: Governing Equations

Assuming steady-flow conditions (i.e. neglecting the transient intermittent processes within the cycle) and applying the conservation of mass (continuity equation) and conservation of energy (first law of thermodynamics) on each component in the system and on the system as a whole one obtains the following equations.

$$\text{Condenser: } q_{cond}=1\ \text{kg}^*(h_1-h_2),\ \text{kJ/kg} \tag{1}$$

$$\text{Constant volume heater: } q_{in}=q_{CVH}=1\ \text{kg}^*(u_1-u_5),\ \text{kJ/kg} \tag{2}$$

Evaporator: $q_{ref}=y*(h_4-h_2)$, kJ/kg (3)

Whole cycle: $COP=q_{ref}/q_{CVH}$ (4)

Whole cycle: $q_{cooling}+q_{cond}=q_{ref}+q_{in}$ (5)

Throttling valve *THV* 03 or *THV* 04: $h_2=h_3$ (6)

Mixing chamber: $y*h_4+(1-y)*h_3=h_5$ (7)

The symbols used above or below are defined as follows.

COP coefficient of performance h enthalpy per unit mass of condensate, kJ $kg^{-1}$ m mass, kg n ratio between the volume of the mixing chamber ($V_{mc}$) and the volume of the heater/cooler volume ($V_{H/C}$)

$q_{cond}$ heat rejected in condenser per unit mass of condensate, kJ $kg^{-1}$ $q_{coooling}$ heat rejected in cooling the refrigerant in the constant volume cooler per unit mass of condensate, kJ $kg^{-1}$ $q_{ref}$ refrigeration effect per unit mass of condensate, kJ $kg^{-1}$ $q_{in}$ heat input to the cycle per unit mass of condensate, kJ $kg^{-1}$ $q_{CVH}$ heat added in constant volume heater per unit mass of condensate, kJ $kg^{-1}$ u internal energy per unit mass of refrigerant, kJ $kg^{-1}$ v specific volume of refrigerant, $m^3$ $kg^{-1}$ V volume, $m^3$ y mass fraction of condensate going to the evaporator per unit mass of condensate Section 2: Analysis of Transient Process FIG. 6A is a schematic diagram for the mixing process #1. The governing conservation equations of mass and energy for this first mixing process are:

Initial condition: $v_5=v_6$ (8)

Final volume after mixing: $V_{M1}=V_5+V_6=V_{mc}+V_{C/H}$ (9)

Mass conservation: $m_{M1}=m_6+m_5$ (10)

Where any mass $m_i$ is given by: $m_i=V_i/v_i$ (11)

Energy conservation during mixing: $E_{in}-E_{out}=\Delta E_{system}$, but $E_{in}=0$ and $E_{out}=0$, hence $0=m_{M1}*u_{M1}-(m_6*u_6+m_5*u_5)$ (12)

Where uM1 is the specific internal energy after valve 09 opens

Substitute (11) into (12) gives $$0=\frac{V_{M1}}{v_{M2}}*u_{M1}-\left(\frac{V_4}{v_6}*u_6+\frac{V_5}{v_5}*u_5\right)$$

Then use (9) gives $$0=\frac{V_5+V_6}{v_{M5}}*u_{M1}-\left(\frac{V_6}{v_6}*u_6+\frac{V_5}{v_5}*u_5\right)$$

Divide by $V_6$ and recall that $V_5/V_6=V_{mc}/V_{C2/H2}=n$ (ratio between the volume of the mixing chamber) and the heater/cooler volume, which is a design parameter to be selected), gives the following equation in only one unknown ($u_{M1}$)

$$0=\frac{n+1}{v_{M1}}*u_{M1}-\left(\frac{1}{v_6}*u_6+\frac{n}{v_5}*u_5\right) \quad (13)$$

FIG. 6B is a schematic diagram for the mixing process #2. The equation (8) through (18) helps to identify the ratio $V_{mc}/V_{C/H}$ (ratio between the volume of the mixing chamber ($V_{mc}$) and the heater/cooler volume ($V_{C/H}$)) as a design parameter that affects both the temperature $T_{M2}$ (at which the isochoric solar heating will start) and the COP of the cycle. This means that the solar thermal energy input to the cycle becomes less due to considering the transient effects. Accordingly, the COP of the cycle would be higher when considering the transient effects.

The governing conservation equations of mass and energy for this second mixing process are:

Initial condition: $v_{M1}=v_1$ (14)

Final volume after mixing: $V_{M2}=V_1+V_{M1}=V_{C1/H1}+V_{mc}+V_{C2/H2}=2\ V_{C/H}+V_{mc}$ (15)

Mass conservation: $m_{M2}=m_6+m_{M1}=1$ kg (16)

Where any mass $m_i$ is given by: $m_i=V_i/v_i$ (17)

Energy conservation during mixing: $E_{in}-E_{out}=\Delta E_{system}$, but $E_{in}=0$ and $E_{out}=0$, hence $0=m_{M2}*u_{M2}-(m_{M1}*u_{M1}+m_1*u_1)$ (18)

Where $u_{M2}$ is the specific internal energy after valve 08 opens.

Substitute (17) into (18) gives $$0=\frac{V_{M2}}{v_{M2}}*u_{M2}-\left(\frac{V_{M1}}{v_{M1}}*u_{M1}+\frac{V_1}{v_1}*u_1\right)$$

Then use of (15) and (9) gives $$0=\frac{2VC/H+V_{mc}}{v_{M2}}*u_{M2}-\left(\frac{V_{mc}+V_{C/H}}{v_{M1}}*u_{M1}+\frac{V_1}{v_1}*u_1\right)$$

Divide by $V_{C/H}$ and recall that $V_{mc}/V_{C2/H2}=n$ (ratio between the volume of the mixing chamber and the heater/cooler volume, which is a design parameter to be selected), gives the following equation in only one unknown ($u_{M2}$)

$$0=\frac{2+n}{v_{M2}}*u_{M2}-\left(\frac{n+1}{v_{M1}}*u_{M1}+\frac{V_1}{v_1}*u_1\right) \quad (19)$$

Taking the above transient effects (due to the above two mixing processes) into consideration, the solar thermal energy input to the constant volume heater after considering the transient effects becomes:

$q_{in}=q_{CVH}=1$ kg$*(u_1-u_{M2})$, kJ/kg (20)

The use of the above transient equations (8) through (20) in the computational analysis with $V_{mc}=n*V_{C/H}$, where n=0.5, 1, 2, 3 and 4 will show that the ratio $n=V_{mc}/V_{C/H}$ (ratio between the volume of the mixing chamber ($V_{mc}$) and the heater/cooler volume ($V_{C/H}$)) is an influential design parameter. This design parameter affects the COP of the cycle and the temperature $T_{M2}$, at which the actual isochoric solar heating and compressing of the refrigerant start (hence affects the value of $u_{M2}$).

Section 3: Simulation Results and Discussion of the Example for Investigation

It is noteworthy that the maximum temperature attainable (at the end of the compression process) in a refrigeration cycle is a main design parameter that has to be considered. It depends on the refrigerant used, the type of the compression process (isentropic, polytropic, constant-volume, etc.), and the conditions (thermodynamic state) of the refrigerant at the beginning of the compression process. A first glance to any property diagram of any refrigerant indicates that for a given initial saturated vapor-state, the constant-volume compression process ends, for any given condenser pressure, with a considerably much higher temperature than a corresponding isentropic process. For example, for an evaporator temperature of 0° C. and condensation temperature of 30° C., the maximum cycle temperature in case of using R134a is only about 33.5° C. for isentropic compression (at s=constant=sg=0.931 kJ/kg. K) and about 3860° C. for constant-volume compression, while the corresponding temperatures in case of using R410a are 42.8° C. and 275.8° C., respectively. This drawback of the constant-volume thermal compression, as compared with the corresponding isentropic or polytropic mechanical vapor compression, has to be remedied in designing refrigeration systems that are intended to use constant-volume thermal compression.

Figure 7A:
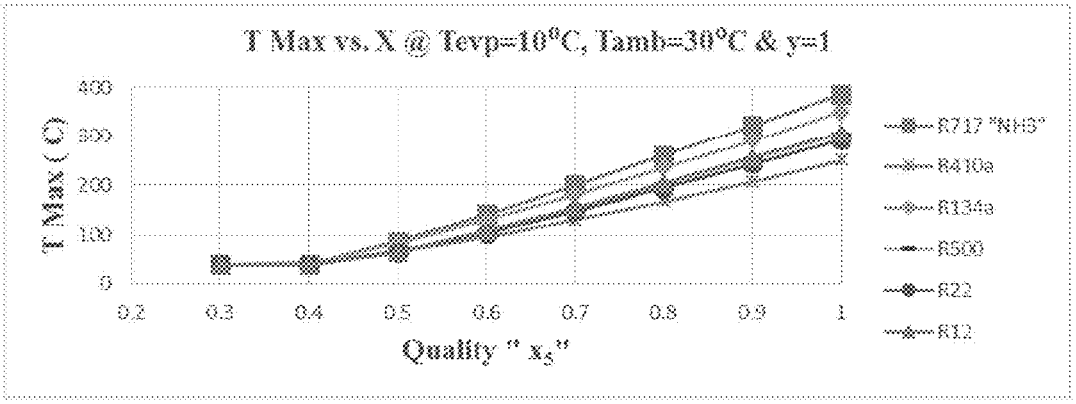
FIG. 7A shows maximum temperature versus the refrigerant quality at entrance to a heater (thermal compressor) for various refrigerants in cycle without mixing after an evaporator, Tambient=30° C. (T ambient represents ambient temperature) and Tevap=10 (Tevap represents produced evaporator temperature)
Figure 7B:
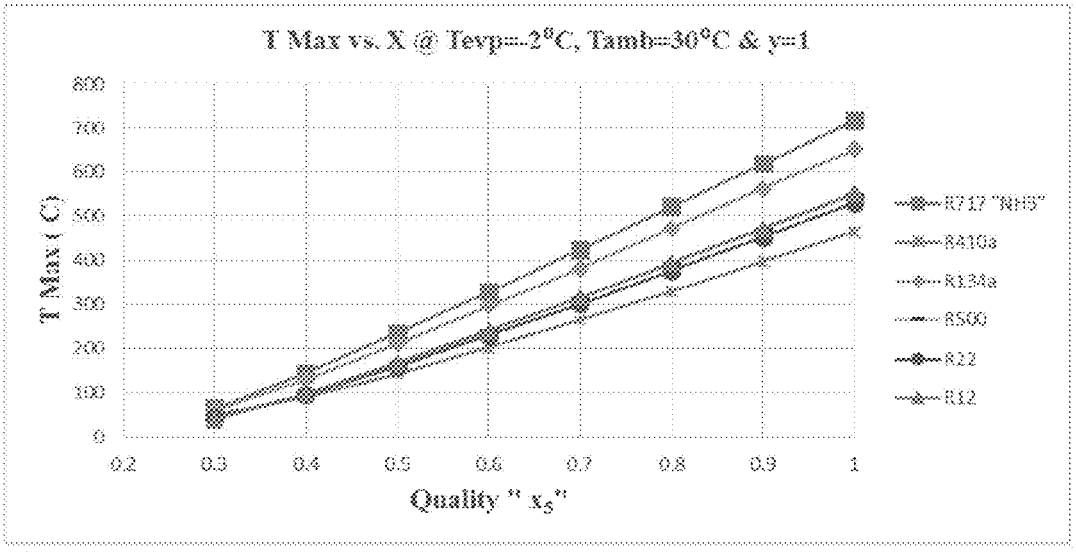
FIG. 7B shows maximum temperature versus the refrigerant quality at entrance to heater (thermal compressor) for various refrigerants in cycle without mixing after the evaporator, Tambient=30° C. and Tevap=−2° C.
Figure 7C:
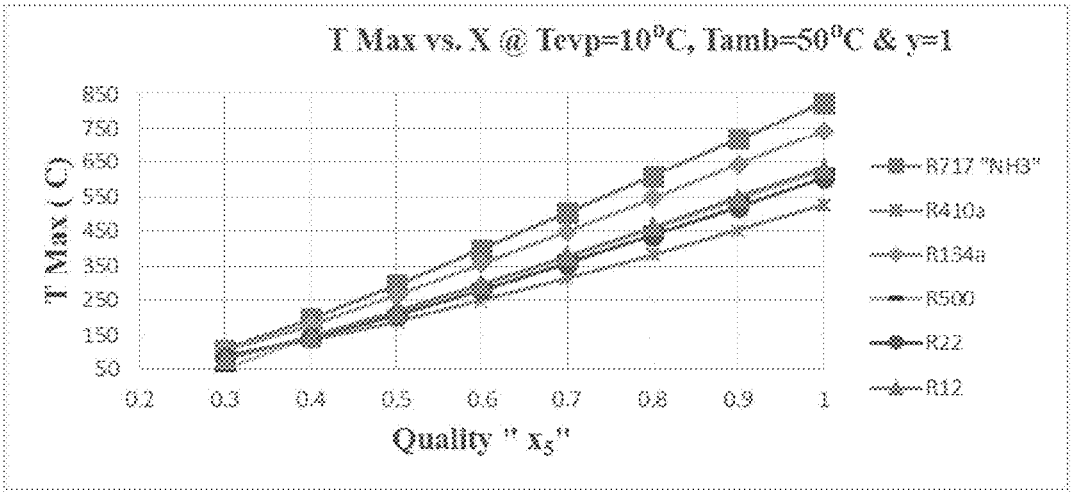
FIG. 7C shows maximum temperature versus the refrigerant quality at entrance to heater (thermal compressor) for various refrigerants in cycle without mixing after the evaporator, Tambient=50° C. and Tevap=10° C.
Figure 7D:
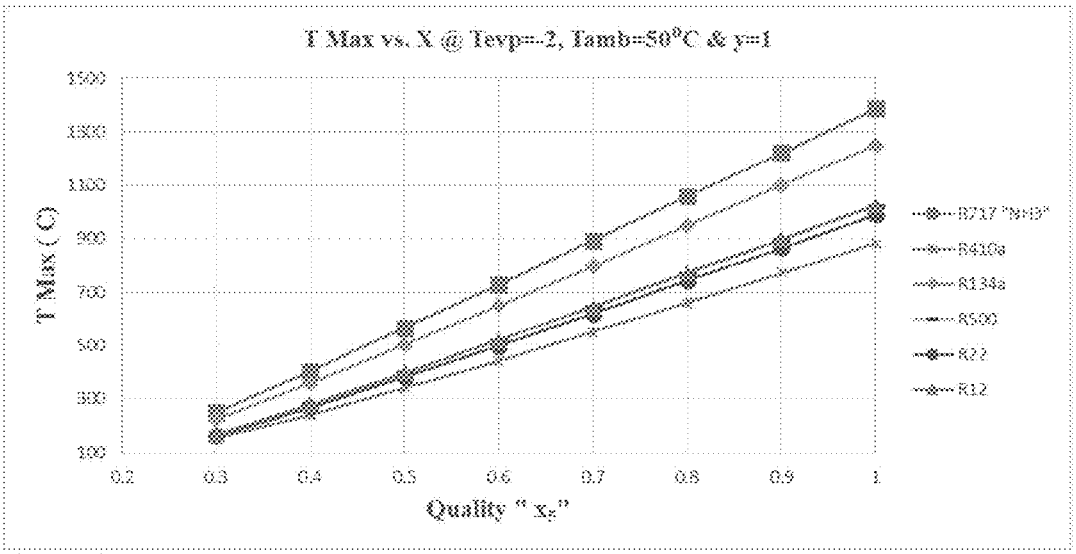
FIG. 7D shows maximum temperature versus the refrigerant quality at entrance to heater (thermal compressor) for various refrigerants in cycle without mixing after the evaporator, Tambient=50° C. and Tevap=−2° C.

(A) Results for the Case with No Mixing Chamber (MC) and Neglecting Transient Effects The case with no mixing between the extracted condensate and the refrigerant exiting the evaporator (y=1), was first investigated with full evaporation in the evaporator (for the sake of comparison with the vapor compression cycle) and with partial evaporation in the evaporator (to reduce the constant-volume cycle maximum temperature). For an ambient temperature of 30° C., which represent a typical spring day/mild day at the beginning of summer in Dhahran City, FIGS. 7A and 7B give the pertinent results. These results include the variation of the maximum temperature in the cycle with the quality x5 of refrigerant at inlet to the thermal compressor (constant-volume heater), for the two selected evaporator temperatures of 10° C. and −2° C., respectively. Similarly, FIGS. 7C and 7D give the variation of the maximum temperature in the cycle with the quality at inlet to the constant-volume thermal compressor (×5). FIGS. 7C and 7D are for the two selected evaporator temperatures of 10° C. and −2° C., respectively, for an ambient temperature of 50° C., which represents a typical hot summer day in Dhahran and many other cities in the gulf region.

The results in these four figures confirm that the maximum attainable temperature (at the end of the constant-volume thermal compression) is in general much higher than that attained by a mechanical isentropic compression, with the exception of cases in which the quality at the beginning of compression is insufficient to produce superheated vapor at the end of compression. For each refrigerant and given evaporator and ambient temperatures, the larger the value of x5 the higher is the maximum attainable cycle temperature, which might reach unacceptable levels for solar energy/waste heat applications or even unacceptable levels for the chemical stability of the refrigerant and/or the strength of the materials of the heaters and the condenser. Moreover, for the condenser temperature to be 10° C. above ambient, if the compressed refrigerant gas is at above 300° C., it would require significant cooling to bring it down to 40° C. (while also taking into account the heat released by condensation).

For each refrigerant and a given ambient temperature, the higher the evaporator temperature, the lower is the maximum attainable cycle temperature. For each refrigerant and a given evaporator temperature, the higher the ambient temperature, the higher is the maximum attainable cycle temperature. In conclusion, in order to have maximum cycle temperatures attainable by non-concentrating low-temperature solar collectors, the quality at the beginning of thermal compression (x5) should be sufficiently low and the proposed system should be used in high-temperature refrigeration (evaporator) applications, such as air conditioning and non-freezing refrigeration.

(B) Results for the Case with a Mixing Chamber (MC) and Neglecting Transient Effects The latter conclusion in the above paragraph is the eason of incorporating, in the proposed system, a refrigerant storage tank (RST) after the condenser and a mixing chamber before the constant-volume thermal compressor.

Figure 8A:
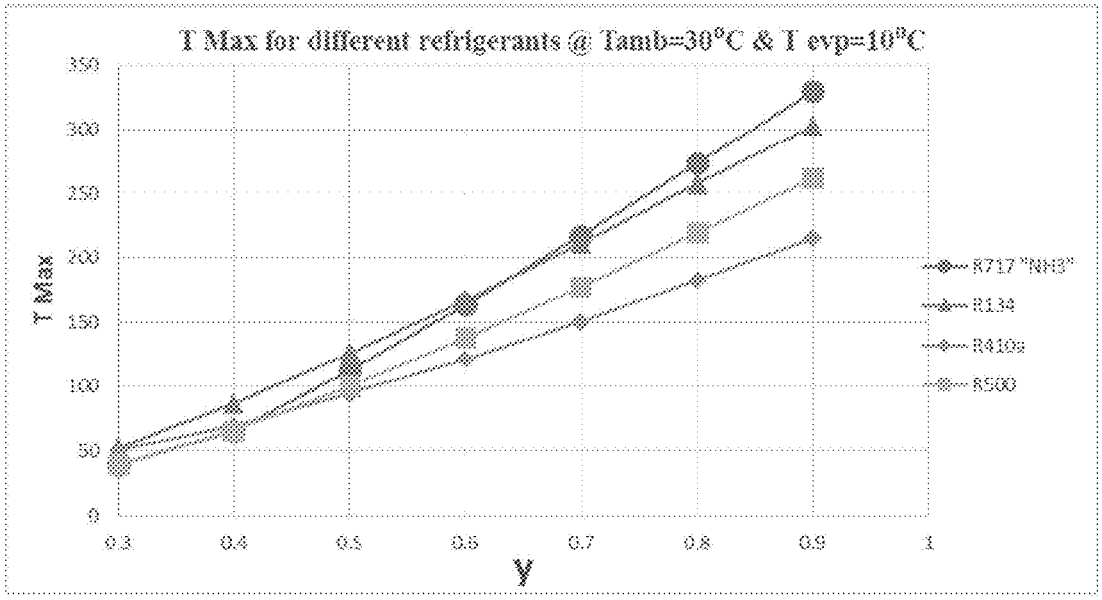
FIG. 8A shows maximum temperature versus the extraction ratio y for various refrigerants in cycle with a mixing chamber after the evaporator, Tambient=30° C. and Tevap=10° C.
Figure 8B:
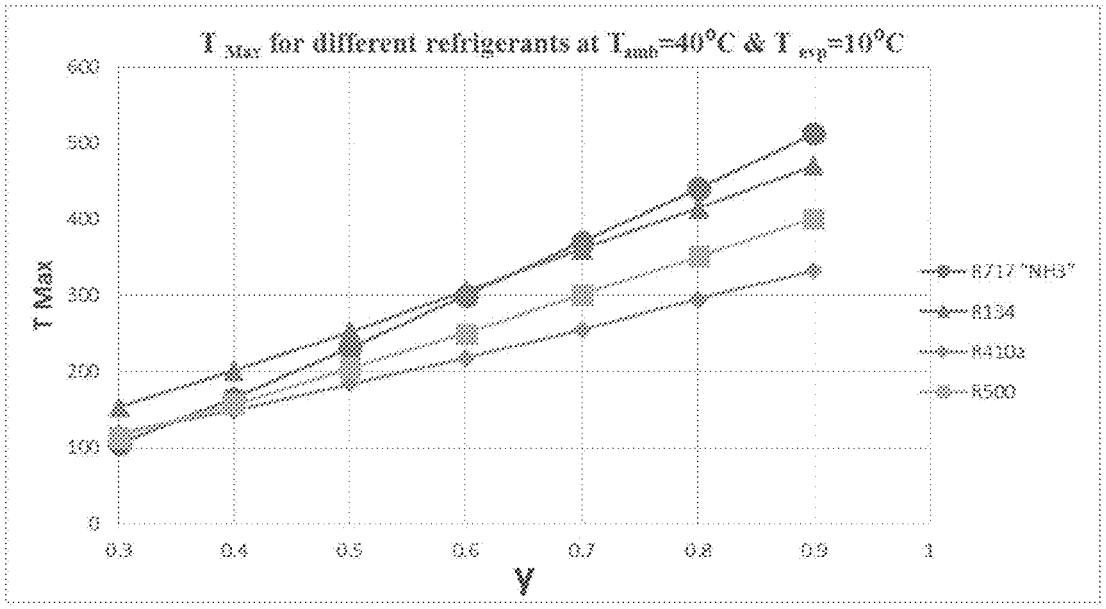
FIG. 8B shows maximum temperature versus the extraction ratio y for various refrigerants in cycle with a mixing chamber after the evaporator, Tambient=40° C. and Tevap=10° C.

The maximum temperature versus the extraction ratio "y" for various refrigerants and a produced evaporator temperature=10° C. is given in FIGS. 8A and 8B for ambient temperatures 30° C. and 40° C., respectively. These figures show that, in general for a given refrigerant, the maximum cycle temperature ($T_{max}$) increases with the ambient temperature and the extraction ratio. Unpresented results for an extreme case with an extraction ratio y=0.9 in a hot summer day of 50° C. ambient temperature, give the required maximum cycle temperature $T_{max}$=677° C., 569° C., 509.4° C. and 478.9° C. for R134a, R500, R717 and R410a, respectively. These required considerably high maximum cycle temperatures can affect the chemical stability of the refrigerant and are surely not suitable for driving the system with a non-concentrating solar collector field. However, with y=0.3 in the same hot summer day of 50° C. ambient temperature, this required maximum cycle temperature reduces to $T_{max}$=301.6° C., 232.60° C., 86.4° C. and 229.2° C. for R134a, R500, R717 and R410a, respectively. Thus, in such a hot summer day of 50° C. ambient temperature the proposed system, only with an extraction ratio "y"=0.3 and using ammonia refrigerant (R717) the system can easily be driven by a low-temperature flat plate solar collector field (since in this case $T_{max}$=86.40° C.).

On the other hand, in a spring/mild summer day of 30° C. ambient temperature, the corresponding required maximum cycle temperatures ($T_{max}$) for y=0.9 are 302.6° C., 261.8° C., 329.4° C. and 215.2° C. for R134a, R500, R717 and R410a, respectively. However, for y=0.3 the required maximum cycle temperatures ($T_{max}$) become less than only 53° C. for all these four refrigerants (40° C. for R500, 50.80° C. for 410a, 52.8° C. for 134a and 40° C. for R717). This means that the proposed totally thermally driven refrigeration system that uses any of these four classical refrigerants can easily be driven by an ordinary flat-plate solar collector field in a spring/mild summer day of 30° C. provided that the extraction ratio y=0.3 (since in this case $T_{max}$<53° C.). From FIG. 8A, it can be seen that this conclusion is also applicable up to y=0.5. However, FIG. 8B indicates that such use of ordinary flat-plate solar collector field can drive the proposed system in summer day of 40° C. with any of the above four refrigerants if the extraction ratio is less than or equal 0.3. However, excluding R134a then any of the other three refrigerants can be used for y=0.3-0.4; R410a and R500 are the best among the three.

The maximum cycle pressure (condenser pressure) is independent of the evaporator temperature, the extraction ratio (y) and the maximum cycle temperature. It only depends on the ambient (condenser cooling medium) temperature and the refrigerant used. FIG. 8C shows the condenser pressure (maximum cycle pressure) as a function of the ambient temperature for the four refrigerants. For a given ambient temperature, R134a then R500 have the lowest pressures with a slight difference between them. On the other hand, R410a requires the highest system pressure followed by ammonia (R717).

Figure 9A:
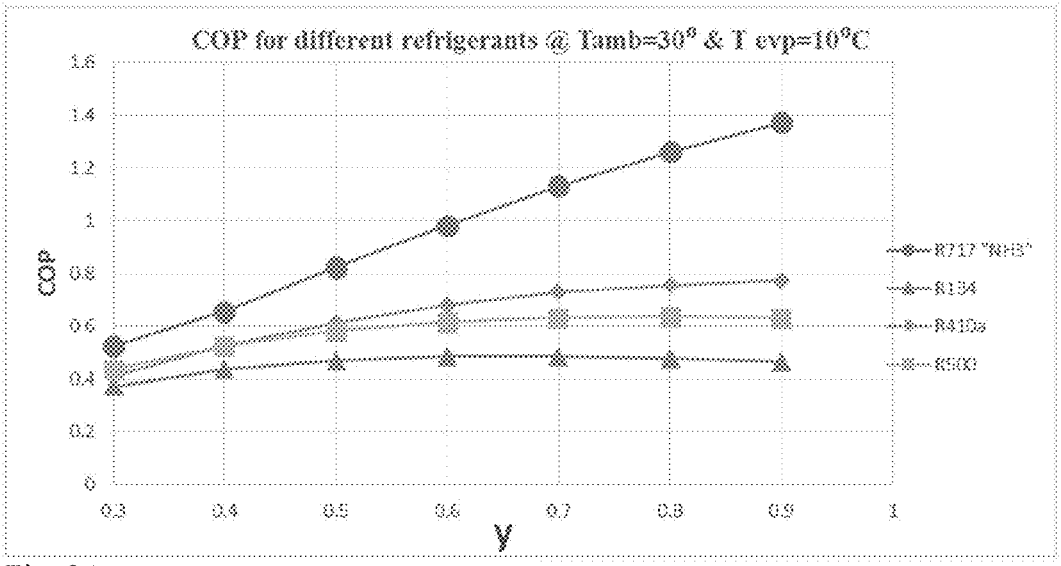
FIG. 9A shows coefficient of performance (COP) versus extraction ratio y for various refrigerants in cycle with a mixing chamber after the evaporator, Tambient=30° C. and Tevap=10° C.
Figure 9B:
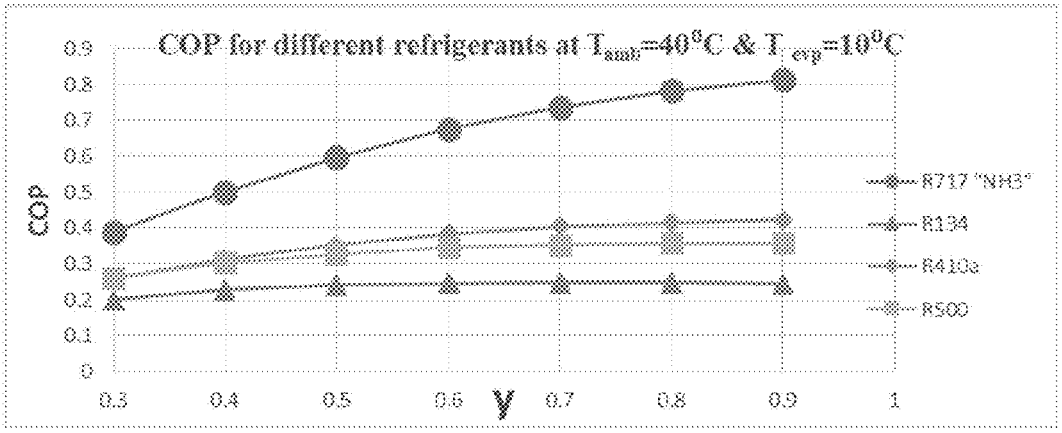
FIG. 9B shows COP versus extraction ratio (y) for various refrigerants in cycle with a mixing chamber after the evaporator, Tambient=40° C. and Tevap=10° C.

FIGS. 9A and 9B give the COP versus extraction ratio (y) for the same four refrigerants in the cycle with a mixing chamber after the evaporator, produced evaporator temperature=10° C., and ambient temperatures=30° C. and 40° C., respectively. As anticipated, these two figures show that, for given refrigerant and extraction ratio (y), as the ambient temperature increases the COP decreases. For a given ambient temperature, R717 has always the highest COP while R134a has always the lowest COP. The COP values for R410a and R500 are in between those of R717 and R134a, with a little advantage to R410a over R500.

The above discussion shows that ammonia (R717) gives the highest COP while R410a and R500 have the lowest T max and hence are the most suitable among the four refrigerants for air conditioning applications with non-concentrating flat-plate solar collector fields (ordinary, with selective surface or evacuated tube type). Accordingly, FIGS. 10A and 10B give the detailed results for the maximum temperature versus the extraction ratio (y), while FIGS. 10C and 10D give the corresponding results of COP versus y, at $T_{evap}$=10° C. and different ambient temperatures for these two particular refrigerants. It is worth mentioning that lower maximum temperatures than those presented in these two figures are needed for evaporator temperatures higher than the 10° C. In fact, air conditioners can easily operate with evaporator temperatures higher than 10° C. and hence the two refrigerants (R410a and R500) become more suitable for the proposed totally thermally driven system in combination with non-concentrating solar collector fields, particularly with low values of the extraction ratio (y).

Figure 11A:
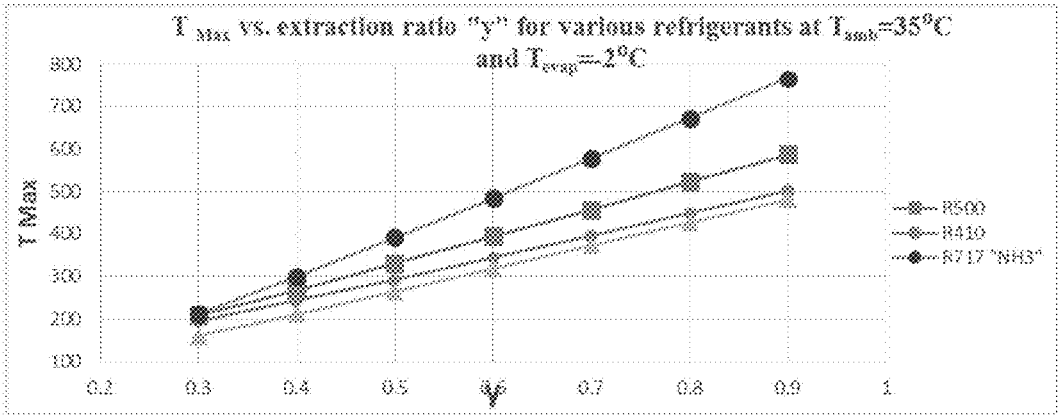
FIG. 11A shows maximum temperature versus the extraction ratio y for various refrigerants in cycle with a mixing chamber after the evaporator, Tambient=35° C. and Tevap=−2° C.
Figure 11B:
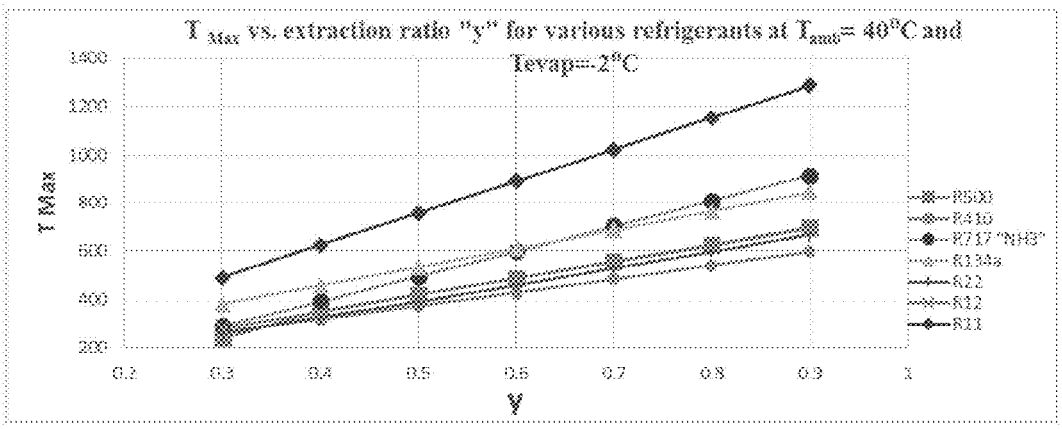
FIG. 11B shows maximum temperature versus the extraction ratio (y) for various refrigerants in cycle with a mixing chamber after the evaporator, Tambient=40° C. and Tevap=−2° C.

FIGS. 11A, 11B and 12A through 12D give the results pertaining for the evaporator temperature −2° C. FIG. 11B incorporates R11, R12 and R22 for the sake of comparison. The present results indicate, as shown in FIG. 11B, that R11 requires the highest maximum cycle temperature, with unacceptable very large non-practical values for solar energy applications at all values of y. The results presented in FIGS. 11A and 11B for $T_{evap}$=−2° C. indicate again that, provided selecting a suitable low value of y, R410a and R500 are the most suitable refrigerants for waste heat/non-concentrating flat-plate solar collector fields. Flat-plate solar collector fields (ordinary, with selective surface or evacuated tube type) are suitable for such a light freezing or cold refrigeration applications that suits preservation of many fruits and vegetables, provided selecting a suitable low value of y with these two particular refrigerants. However, in case of non-concentrating flat-plate solar collector fields the ambient temperature should be less than 40° C. and y should be less than 0.4. For these two particular refrigerants, FIGS. 12A and 12B give the detailed results for the maximum temperature versus the extraction ratio (y), while FIGS. 12C and 12D give the corresponding results of COP versus y, at $T_{evap}$=−2° C. and different ambient temperatures. Results in FIGS. 12A and 12B indicate that, for producing such an evaporator temperature of −2° C. these two particular refrigerants are suitable for flat-plate solar collectors provided the ambient temperature is not above 30° C. and the extraction ratio y is less than 0.4, with some advantage of R410a over R 500.

(C) Results for the Case with a Mixing Chamber (MC) and Considering Transient Effects The results for this case represent the actual (without simplifying assumptions) results for the proposed system. FIGS. 13-16 present sample of these results for only R410a, the most favorable refrigerant for flat-plate solar collectors (based on the above findings), and only y=0.4 (the maximum recommended value of y for sufficiently low values of T max that are achievable by flat-plate solar collectors). FIGS. 13-16 show that, the transient effects generally increase the COP of the cycle due to increasing the value of $T_{M2}$ and hence reducing the solar thermal heat input needed. These figures also indicate that the ratio n between the volume of the mixing chamber ($V_{mc}$) and the volume of the heater/cooler ($V_{H/C}$) is an influential design parameter for the proposed system. Decreasing the value of n (i.e. reducing the volume of the mixing chamber ($V_{mc}$) for a given volume of the heater/cooler ($V_{H/C}$), or vice versa) gives much better performance.

With values of n<1, the improvement in the performance becomes very noticeable and the main drawback of low COP values in the previous section (B), due to neglecting the transient effects with this cycle, disappears. For example, for R410a (50% R-125, 50% R-32), $T_{ambient}$=30° C., $T_{evp}$=10° C., and y=0.4, FIG. 13A shows that, for all investigated values of n≤4, the COP of the proposed cycle is more than that of the single effect LiBr-water absorption that uses low grade heat and can deliver a COP of 0.7. As this figure also shows, a very remarkable high value of COP (about 2.5) is achievable with n=0.5, i.e. $V_{MC}$=½ $V_{H/C}$ (the volume of the mixing chamber is half that of the heater/cooler).

The designer should be aware of the very large values of $T_{max}$ sometimes stated in the various figures. For example, the considered refrigerants cannot remain chemically stable at very large values of $T_{max}$ (e.g. 800° C.). Therefore, he should avoid such very large values of $T_{max}$ by selecting low values of y.

The proposed novel cycle can be realized with most of the known refrigerants in thermally driven refrigeration systems for both air conditioning and preservation of vegetables and fruits applications. The high-grade mechanical work required in the popular vapor-compression systems has been replaced in the proposed new cycle by the low-grade thermal energy. The proposed novel cycle can be solar driven using low-temperature solar collector fields and utilized for air conditioning with some of the known refrigerants, particularly R410a and R500, as the working substance. With a heat-storage facility, the proposed solar-driven novel refrigeration cycle can operate 24 hours a day. For refrigeration, applications that suit preservation of fruits and vegetables the results indicate that the proposed novel cycle can be used with many of the known refrigerants when a parabolic dish solar concentrator drives it. However, for such preservation of fruits and vegetables the non-concentrating flat-plate solar collector fields can still drive the proposed novel cycle when using R410a or R500 as the working substance if the ambient temperature is not exceeding 30° C. and the extraction ratio (y) is below 0.4.

The ratio n between the volume of the mixing chamber ($V_{mc}$) and the volume of the heater/cooler ($V_{H/C}$) is an influential design parameter for the proposed system. Decreasing the value of n (i.e. reducing the volume of the mixing chamber ($V_{mc}$) for a given volume of the heater/cooler ($V_{H/C}$), or vice versa) gives much better performance. With values of n<1, the improvement in the performance becomes very noticeable and remarkable high values of COP are achievable.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. A solar driven refrigeration system, comprising:

a condenser that receives a compressed refrigerant, and condenses the compressed refrigerant to produce a refrigerant condensate;

a storage tank that stores the refrigerant condensate;

an evaporator that receives a first portion of the refrigerant condensate from the storage tank, and evaporates the first portion of the refrigerant condensate to produce a refrigerant vapor;

a mixing chamber that receives the refrigerant vapor from the evaporator, and a second portion of the refrigerant condensate from the storage tank, and produce a refrigerant mixture of the refrigerant vapor and the second portion of the refrigerant condensate;

a first refrigerant compressor between the mixing chamber and condenser, having a constant volume, and capable of operating in a heater mode or a cooler mode, the first refrigerant compressor receiving the refrigerant mixture from the mixing chamber, and compressing the refrigerant mixture to produce the compressed refrigerant using solar energy;

a second refrigerant compressor in parallel with the first refrigerant compressor between the mixing chamber and condenser, having a constant volume, and capable of operating in a heater mode or a cooler mode, the second refrigerant compressor receiving the refrigerant mixture from the mixing chamber and compressing the refrigerant mixture to produce the compressed refrigerant using solar energy; and one or more flow control valves between the mixing chamber and the first and second refrigerant compressors that are configured to cause the first and second refrigerant compressors to be disconnected from the mixing chamber at a same time, cause the first and second refrigerant compressors to be connected with the mixing chamber at a same time, and cause one of the first and second refrigerant compressors to discharge to the mixing chamber without passing through the condenser while the other one of the first and second refrigerant compressors is fed from the mixing chamber.

2. The refrigeration system of claim 1, wherein the storage tank includes a control device configured to control a proportion of the first portion of the refrigerant condensate to the second portion of the refrigerant condensate according to a preconfigured extraction ratio.

3. The refrigeration system of claim 1, wherein the first refrigerant compressor and the second refrigerant compressor operates according to the following steps:

the first refrigerant compressor heats a first portion of the refrigerant mixture contained in the first refrigerant compressor to produce a compressed refrigerant, and the second refrigerant compressor cools a second portion of the refrigerant mixture contained in the second refrigerant compressor;

the first refrigerant compressor feeds the compressed refrigerant to the condenser, and the second refrigerant compressor is connected to the mixing chamber;

the first refrigerant compressor is connected to the mixing chamber while the second refrigerant compressor keeps being connected to the mixing chamber, wherein the first refrigerant compressor discharges to the mixing chamber and the second refrigerant compressor is fed from the mixing chamber;

the first and second refrigerant compressors are disconnected from the mixing chamber; and the first refrigerant compressor cools a third portion of the refrigerant mixture contained in the first refrigerant compressor, and the second refrigerant compressor heats a fourth portion of the refrigerant mixture contained in the second refrigerant compressor to produce a compressed refrigerant.

4. The refrigeration system of claim 1, wherein the solar energy generated from a flat-plate solar collector.

5. The refrigeration system of claim 1, further comprising a directional control valve between the evaporator and the mixing chamber that is closed when the first or the second refrigeration compressor is connected to the mixing chamber.

6. The refrigeration system of claim 1, wherein the refrigerant is one of R410a, R500, R134a, and R717.

7. A method for operating a solar driven thermal-compression refrigeration system, comprising:

condensing, at a condenser, a compressed refrigerant to produce a refrigerant condensate;

storing, at a storage tank, the refrigerant condensate;

receiving, at an evaporator, a first portion of the refrigerant condensate from the storage tank;

evaporating at the evaporator, the first portion of the refrigerant condensate to produce a refrigerant vapor;

receiving, at a mixing chamber, the refrigerant vapor;

receiving, at the mixing chamber, a second portion of the refrigerant condensate from the storage tank;

mixing, at the mixing chamber, the refrigerant vapor and the second portion of the refrigerant condensate to produce a refrigerant mixture; and compressing the refrigerant mixture to produce the compressed refrigerant using solar energy with a first refrigerant compressor and a second refrigerant compressor wherein the step of compressing the refrigerant mixture to produce the compressed refrigerant using solar energy includes discharging the refrigerant mixture from one of the first and second refrigerant compressors to the mixing chamber without passing through the condenser while feeding the other one of the first and second refrigerant compressors from the mixing chamber.

8. The method of claim 7, wherein the step of compressing the refrigerant mixture to produce the compressed refrigerant using solar energy further includes:

heating a first portion of the refrigerant mixture contained in the first refrigerant compressor to produce a first portion of the compressed refrigerant, and cooling a second portion of the refrigerant mixture contained in the second refrigerant compressor, the first and second refrigerant compressors each having a constant volume, and capable of operating in a heater mode or a cooler mode;

feeding the first portion of the compressed refrigerant to the condenser at the first refrigerant compressor, and connecting the second refrigerant compressor to the mixing chamber;

connecting the first refrigerant compressor to the mixing chamber, and keeping the second refrigerant compressor being connected to the mixing chamber, wherein the first refrigerant compressor discharges to the mixing chamber and the second refrigerant compressor is fed from the mixing chamber;

cooling a third portion of the refrigerant mixture contained in the first refrigerant compressor, and heating a fourth portion of the refrigerant mixture contained in the second refrigerant compressor to produce a second portion of the compressed refrigerant;

connecting the first refrigerant compressor to the mixing chamber, and feeding the second portion of the compressed refrigerant to the condenser at the second refrigerant compressor; and connecting the second refrigerant compressor to the mixing chamber and keeping the first refrigerant compressor being connected to the mixing chamber.

9. The method of claim 7, further comprising:

controlling a proportion of the first portion of the refrigerant condensate to the second portion of the refrigerant condensate according to a preconfigured extraction ratio.

10. The method of claim 7, further comprising:

closing a directional control valve between the evaporator and the mixing chamber when the first or the second refrigeration compressor is connected to the mixing chamber.

11. The method of claim 7, wherein the solar energy generated from a flat-plate solar collector.

12. The method of claim 7, wherein the refrigerant is one of R410a, R500, R134a, and R717.

13. The refrigeration system according to claim 1, wherein the condenser is an evaporative condenser.

14. The refrigeration system according to claim 1, having no rotary or reciprocating compressor.

15. The system according to claim 1, wherein the compressor is a thertnal compressor.

* * * * *